US008720686B1

(12) United States Patent
Shuman

(10) Patent No.: US 8,720,686 B1
(45) Date of Patent: May 13, 2014

(54) LIDDED CONTAINER WITH SIGNALING ASSEMBLY

(71) Applicant: Keith E. Shuman, Maricopa, AZ (US)

(72) Inventor: Keith E. Shuman, Maricopa, AZ (US)

( * ) Notice: Subject to any disclaimer, the term of this patent is extended or adjusted under 35 U.S.C. 154(b) by 0 days.

(21) Appl. No.: 14/159,662

(22) Filed: Jan. 21, 2014

Related U.S. Application Data

(60) Provisional application No. 61/764,643, filed on Feb. 14, 2013.

(51) Int. Cl.
*B65D 85/00* (2006.01)

(52) U.S. Cl.
USPC ..... 206/459.1; 40/306; 220/908

(58) Field of Classification Search
USPC ..... 206/459.1, 459.5, 767, 768; 40/306, 40/307, 312, 313; 220/908, 908.1, 908.2, 220/908.3, 909, 910, 911
See application file for complete search history.

(56) References Cited

U.S. PATENT DOCUMENTS

| | | | | |
|---|---|---|---|---|
| 795,239 | A | 7/1905 | Smith | |
| 1,512,337 | A | 10/1924 | Jackson | |
| 3,300,083 | A * | 1/1967 | Wright | 141/95 |
| 3,968,928 | A | 7/1976 | Caldwell | |
| 4,382,542 | A | 5/1983 | Farris | |
| 4,771,941 | A | 9/1988 | Bowman et al. | |
| D349,926 | S | 8/1994 | Junge | |
| 5,634,589 | A | 6/1997 | Greene | |
| 6,295,946 | B1 | 10/2001 | Kasik | |
| 6,448,898 | B1 | 9/2002 | Kasik | |
| 6,808,081 | B1 * | 10/2004 | Citro | 220/772 |
| D602,223 | S | 10/2009 | Stegeby | |
| 8,231,000 | B2 | 7/2012 | Gonzalez et al. | |
| 2002/0030595 | A1 | 3/2002 | Kasik | |
| 2009/0126473 | A1 | 5/2009 | Porat et al. | |
| 2013/0098794 | A1 * | 4/2013 | Clancy et al. | 206/459.1 |

* cited by examiner

*Primary Examiner* — Jacob K Ackun
(74) *Attorney, Agent, or Firm* — Parsons & Goltry; Michael W. Goltry; Robert A. Parsons

(57) ABSTRACT

A lidded container assembly includes a container having a lid that rotates between a closed position to close the container and an opened position to open the container. A coupling assembly joins a flag and the container to allow rotation of the flag between lowered and raised positions. When the container is moved from an upright position to an inverted position, gravity moves the lid from the closed position to the open position, and the lid acts on the flag positioned over the lid to overcome friction between the coupling assembly and the container to rotate the flag from the lowered position to the raised position. When the container is returned to the upright position, gravity moves the lid from the open position to the closed position, and the friction between the coupling assembly and the container automatically holds the flag in the raised position.

17 Claims, 18 Drawing Sheets

LIDDED CONTAINER WITH SIGNALING ASSEMBLY

CROSS-REFERENCE TO RELATED APPLICATION

This application is a non-provisional of U.S. Provisional Patent Application Ser. No. 61/764,643, filed on Feb. 14, 2013, which is incorporated herein by reference.

FIELD OF THE INVENTION

The present invention relates to lidded containers and for signaling when a lidded container has been emptied, primarily for purposes of identifying lidded containers which call for retrieval after being emptied.

BACKGROUND OF THE INVENTION

The collection and disposition of refuse, common commercial and domestic waste and trash and recyclables colloquially referred to as garbage, has become highly sophisticated, mechanized and automated. Initially, the refuse is deposited and temporarily stored in a conveniently located container. Subsequently, the container is moved to a collection site where the contents of the container are received by a refuse collection vehicle for ultimate transfer to a disposal site. The vehicle, usually operating on a regular periodic schedule, is generally capable of accommodating numerous containers.

Refuse containers for the instant purpose are readily commercially available in various sizes, types, and configurations. Common, for example, are stationary containers and portable containers, large containers and small containers, and round containers and square containers. Large round containers, usually permanently positioned at a central location for multiple users, have a capacity ranging to four hundred gallons and a diameter as large as forty-eight inches. Square containers, with a transverse measurement in the range of fourteen inches to twenty-nine inches, have a nominal capacity of forty to ninety gallons. Having capacities beginning at approximately thirty gallons and diameters of fifteen inches, small round containers are frequently fitted with wheels for mobility. Such wheeled containers are used in residential areas, which are wheeled back-and-forth from the curb for curb-side collection commensurate with the periodic collection schedule.

The foregoing measurements and geometric configurations are taken in cross-section at the gripping surface or perimeter which typically resides approximately twenty-eight inches above the supporting surface. In actuality, each container is defined by a continuous, upright sidewall having a taper in the general range of four to seven degrees which accommodates mold release and stacking. Preferably fabricated of polyethylene by various conventional molding processes, the typical container is characterized by a relatively flexible sidewall having a substantially smooth exterior surface, an opening for the transfer of refuse to and from the container, and a lid used to open and close the opening.

The conventional refuse collection vehicle includes a cab, a body and a container handling mechanism carried upon a wheeled chassis. The container handling mechanism is controlled remotely by an operator from within the cab of the collection vehicle. The body is generally bipartite, having a hopper and a stowage bin for respectively receiving and stowing refuse. Refuse handling means, usually termed a packer, transfers and compacts refuse from the hopper to the stowage bin.

Typically, the container handling mechanism includes a gripping apparatus carried at the end of a lifting member or boom which is extendable and retractable relative to the curb or pick-up side of the vehicle. During travel of the vehicle, the container handling mechanism resides in a retracted position with the gripping apparatus juxtaposed along the side of the vehicle. After the vehicle is brought to a stop, the boom is extended and the gripping apparatus engaged about the container. The boom is then elevated to position the container atilt or inverted over the hopper for deposit of the refuse. Successively, the boom is lowered, the container released upright, and the container handling mechanism retracted for stowage during subsequent movement of the vehicle.

After containers have been emptied, they are repositioned to a convenient location and are used to take on refuse until the next scheduled collection period, at which point the containers are again moved to the appointed collection site. Oftentimes efforts are made to reposition the containers before they have been emptied, which is a waste of time and energy and is, moreover, frustrating. To alleviate this problem, there is a need in the art for a convenient and efficient way to indicate whether a container has been emptied and ready to be moved from the appointed collection site back to the convenient location for rubbish collection in preparation for the next scheduled collection period.

SUMMARY OF THE INVENTION

According to the principle of the invention, a lidded container assembly includes a container having a body for receiving contents through an opening formed in the container, and a lid mounted to the body for rotation between a closed position to enclose the opening and an opened position to open the opening. A flag extends from a coupling assembly that joins the container and the flag to allow rotation of the flag between a lowered position over the lid in the closed position thereof and a raised position. Friction between the coupling assembly and container resists relative rotation between the flag and the container. When the container is moved from an upright position to an inverted position, gravity automatically moves the lid from the closed position to the open position, and the lid acts on the flag positioned over the lid to overcome the friction between the coupling assembly and the container to rotate the flag from the lowered position to the raised position. When the container is subsequently returned from the inverted position to the upright position, gravity automatically moves the lid from the open position to the closed position, the friction between the coupling assembly and the container automatically holds the flag in the raised position, gravity is insufficient to overcome the friction between the coupling assembly and the container to rotate the flag from the raised position to the lowered position, and only a force greater than gravity is required to overcome the friction between the coupling assembly and the container to rotate the flag from the raised position to the lowered position. The container includes a handle, and the coupling assembly joins the handle of the container and the flag. The coupling assembly includes couplers that each includes a split collar on the handle, and a clamp assembly clamped on the split collar. The clamp assembly joins the split collar and the flag to allow rotation of the clamp assembly relative to the split collar to, in turn, allow rotation of the flag relative the split collar and the handle of the hinged connection between the lowered position of the flag and the raised position of the flag. The friction is between the split collar and the clamp assembly. In a particular embodiment, the split collar is adhesively adhered on the handle, the split collar extends around the handle, and the clamp assembly extends around the split collar. An engagement assembly, such as a tongue-and-groove assembly, joins the flag to the clamp assembly.

A lidded container assembly includes a container having a body for receiving contents through an opening formed in the container, a lid, and a hinged connection that joins the body and the lid to allow the lid to rotate relative to the body between a closed position to enclose the opening and an opened position to open the opening. A flag extends from a coupling assembly that joins the hinged connection and the flag to allow rotation of the flag relative to the hinged connection between a lowered position over the lid in the closed position thereof and a raised position. Friction between the coupling assembly and the hinged connection resists relative rotation between the flag and the hinged connection. When the container is moved from an upright position to an inverted position, gravity automatically moves the lid from the closed position to the open position, and the lid acts on the flag positioned over the lid to overcome the friction between the coupling assembly and the hinged connection to rotate the flag from the lowered position to the raised position. When the container is subsequently returned from the inverted position to the upright position, gravity automatically moves the lid from the open position to the closed position, the friction between the coupling assembly and the hinged connection automatically holds the flag in the raised position, gravity is insufficient to overcome the friction between the coupling assembly and the hinged connection to rotate the flag from the raised position to the lowered position relative to the hinged connection, and only a force greater than gravity is required to overcome the friction between the coupling assembly and the hinged connection to rotate the flag from the raised position to the lowered position relative to the hinged connection. The hinged connection includes a handle coupled with the lid and a pair of journals extending from the body and engaging opposed ends of the handle. The coupling assembly is connected to the handle. The coupling assembly includes couplers that each includes a split collar on the handle, and a clamp assembly clamped on the split collar. The clamp assembly joins the split collar and the flag to allow rotation of the clamp assembly relative to the split collar to, in turn, allow rotation of the flag relative the split collar and the handle of the hinged connection between the lowered position of the flag and the raised position of the flag. The friction is between the split collar and the clamp assembly. In a particular embodiment, the split collar is adhesively adhered on the handle, the split collar extends around the handle, and the clamp assembly extends around the split collar. An engagement assembly, such as a tongue-and-groove assembly, joins the flag to the clamp assembly.

A method for signaling that a lidded container assembly has been emptied and that the lidded container assembly is ready for retrieval after being emptied, wherein the lidded container assembly includes a container having a body for receiving contents through an opening formed in the container, a lid mounted to the body for rotation between a closed position to enclose the opening and an opened position to open the opening, a flag extending from a coupling assembly that joins the container and the flag to allow rotation of the flag between a lowered position over the lid in the closed position thereof and a raised position, and friction between the coupling assembly and container that resists relative rotation between the flag and the container, wherein the method includes locating the container in an upright position with the lid in the closed position and the flag in the lowered position over the lid, moving the container from the upright position to an inverted emptying position automatically rotating the lid from the closed position to the open position responsive to gravity, and the lid acting on the flag overcoming the friction between the coupling assembly and the hinged connection automatically rotating the flag from the lowered position to the raised position responsive to rotation of the lid from the closed position to the open position, and moving the container from the inverted emptying position to the upright position automatically rotating the lid from the open position to the closed position responsive to gravity, and automatically holding the flag in the raised position responsive to the friction signaling that the lidded container assembly has been emptied and that the lidded container assembly is ready for retrieval, wherein gravity is insufficient to overcome the friction between the coupling assembly and the container to rotate the flag from the raised position to the lowered position, and only a force greater than gravity is required to overcome the friction between the coupling assembly and the container to rotate the flag from the raised position to the lowered position.

A method for signaling that a lidded container assembly has been emptied and that the lidded container assembly is ready for retrieval after being emptied, wherein the lidded container assembly includes a container having a body for receiving contents through an opening formed in the container, a lid, and a hinged connection that joins the body and the lid to allow the lid to rotate relative to the body between a closed position to enclose the opening and an opened position to open the opening, a flag extending from a coupling assembly that joins the hinged connection and the flag to allow rotation of the flag relative to the hinged connection between a lowered position over the lid in the closed position thereof and a raised position, and friction between the coupling assembly and the hinged connection that resists relative rotation between the flag and the hinged connection, wherein the method includes locating the container in an upright position with the lid in the closed position and the flag in the lowered position over the lid, moving the container from the upright position to an inverted emptying position automatically rotating the lid from the closed position to the open position responsive to gravity, and the lid acting on the flag overcoming the friction between the coupling assembly and the hinged connection automatically rotating the flag from the lowered position to the raised position responsive to rotation of the lid from the closed position to the open position, and moving the container from the inverted emptying position to the upright position automatically rotating the lid from the open position to the closed position responsive to gravity, and automatically holding the flag in the raised position responsive to the friction signaling that the lidded container assembly has been emptied and that the lidded container assembly is ready for retrieval, wherein gravity is insufficient to overcome the friction between the coupling assembly and the hinged connection to rotate the flag from the raised position to the lowered position relative to the hinged connection, and only a force greater than gravity is required to overcome the friction between the coupling assembly and the hinged connection to rotate the flag from the raised position to the lowered position relative to the hinged connection.

BRIEF DESCRIPTION OF THE DRAWINGS

Referring to the drawings.

DETAILED DESCRIPTION

Figure 1:
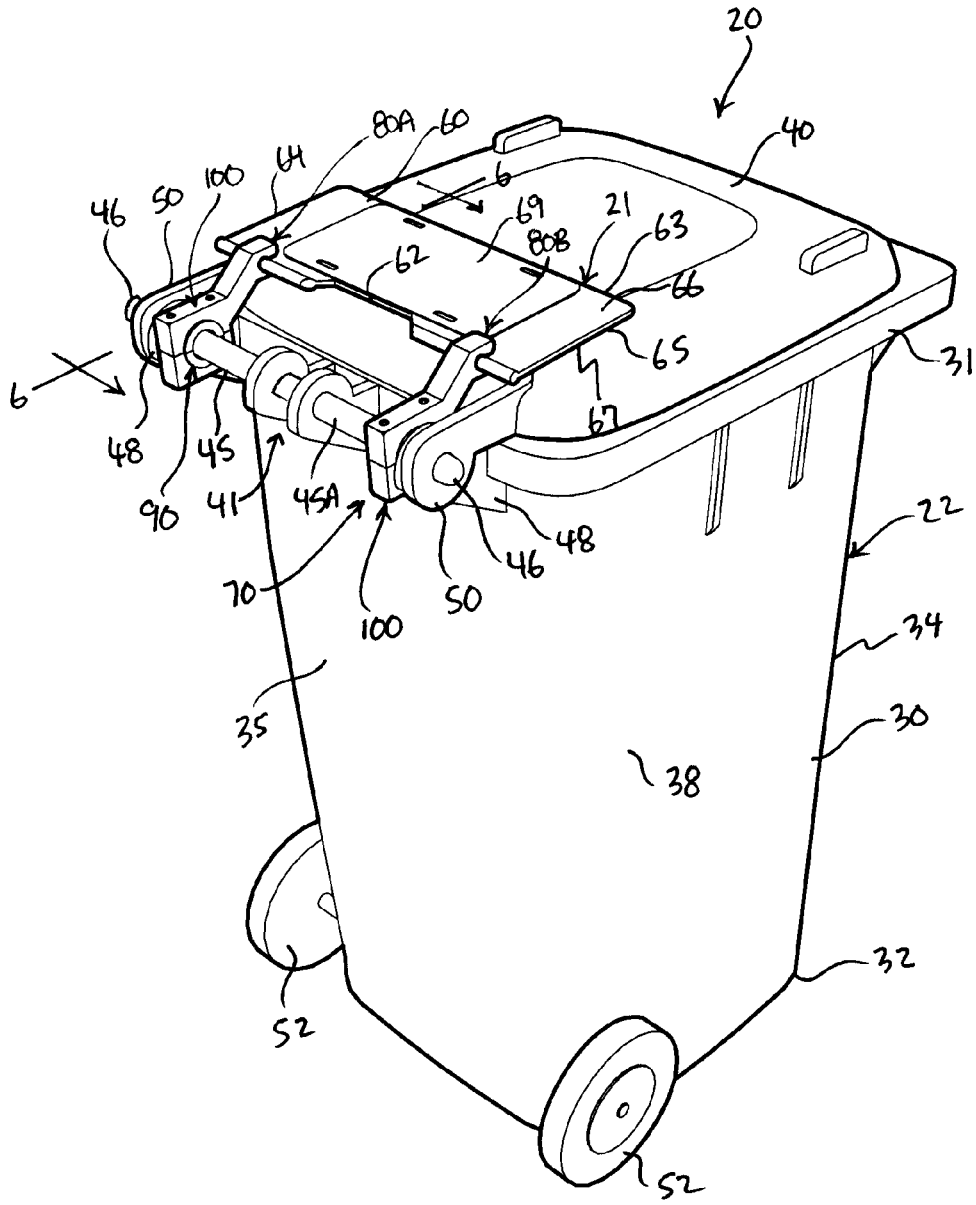
FIG. 1 is a perspective view of a lidded container assembly including a signaling assembly, and a container having a lid shown in a closed position.
Figure 7:
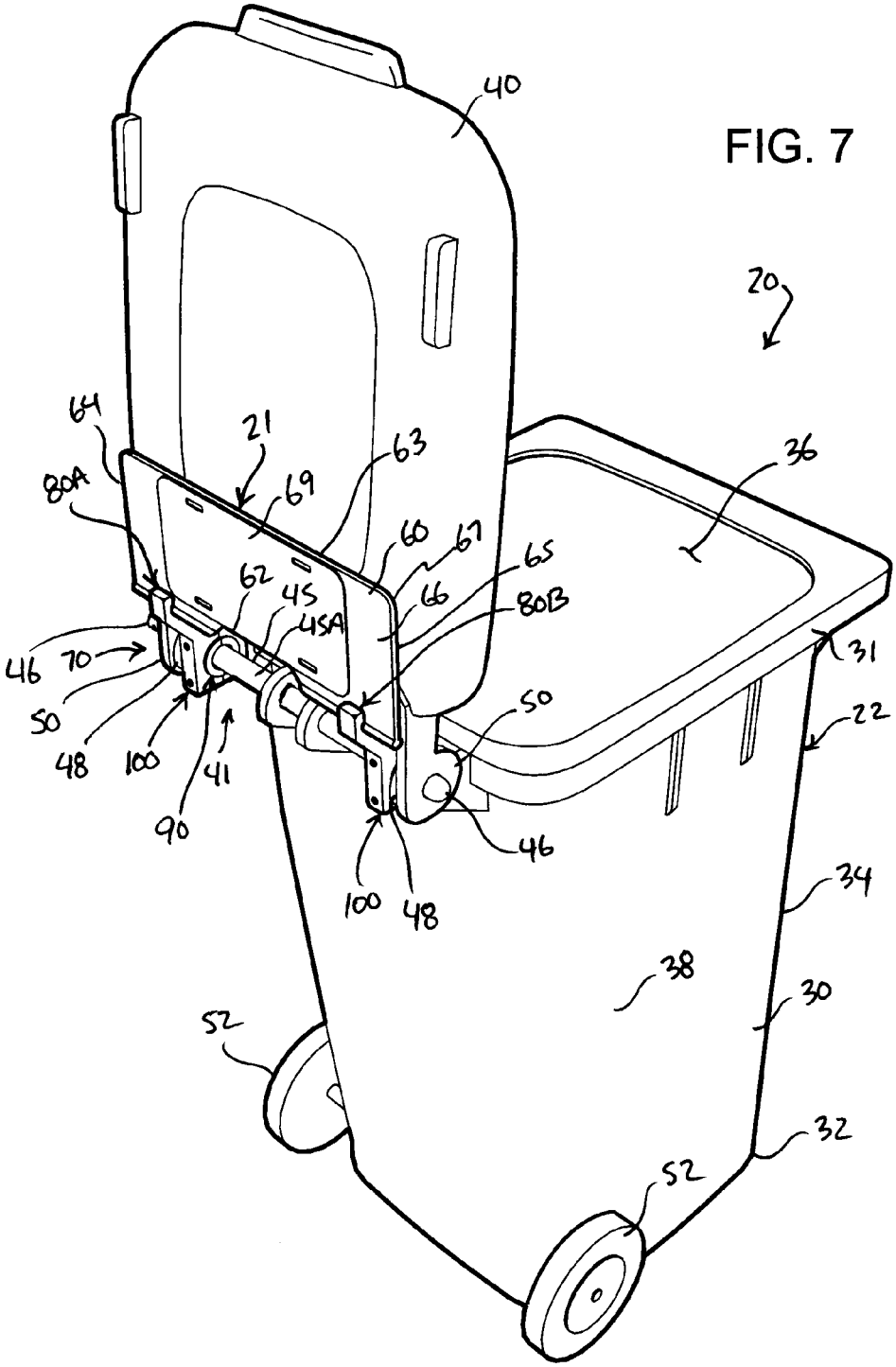
FIG. 7 is a perspective view of the embodiment of FIG. 1, with the lid in an opened position and the signaling device in a signaling position.
Figure 8:
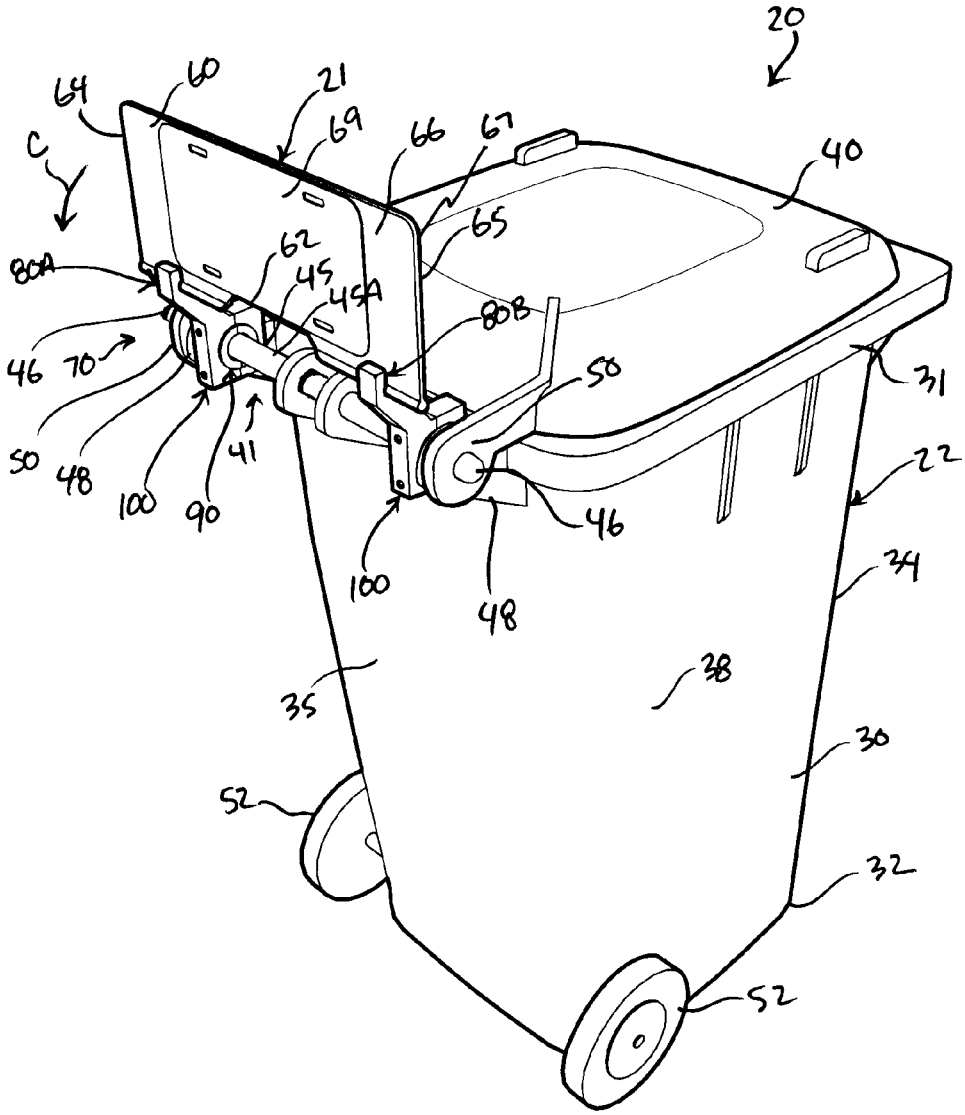
FIG. 8 is a perspective view of the embodiment of FIG. 1 with the lid returned to the closed position after having been opened and the signaling device retained via friction in a signaling position.

Turning now to the drawings, in which like reference characters indicate corresponding elements throughout the several views, attention is first directed to FIGS. 1, 7, and 8, in which there is seen a lidded container assembly 20 including, in combination, a signaling assembly 21, and a container 22. Container 22 is used for containing refuse to be periodically collected by a refuse collection vehicle commensurate with a regular periodic refuse collection schedule, and signaling assembly 21 indicate whether container 22 has been emptied by a refuse collection vehicle to let the owner or custodian of container 22 know that container 22 is empty and is ready to be moved to a convenient location for use in taking on refuse until the next scheduled refuse collection period.

Container 22 is itself entirely conventional, corresponding to any of a variety of known containers, and generally includes a body 30 having a top 31, a closed bottom 32, a front or curb end 34, a rear end 35, an opening 36 defined in top 31 shown in FIG. 7, a lid 40, and a hinged connection 41 that extends from rear end 35 near top 31 of body 30 of container 22. Body 30 is for receiving contents through opening 36. Body 30 is preferably constructed as a single piece, having a gripping portion 38 between top 31 and bottom 32, configured to be conventionally engaged by a gripping apparatus of a collection vehicle. Lid 40 is connected to body 30 of container 22 with hinged connection 41 to allow lid 40 to rotate between a lowered closed position, shown in FIGS. 1 and 8, to enclose opening 36 into body 30 of container 22 so as close body 30 of container 22, and a raised or upright opened position, shown in FIG. 7, to open opening 36 into body 30 of container 22 so as to open body 30 of container 22.

Hinged connection 41 of container 22 extends from rear end 35 near top 31 of body 30 of container 22, and includes a handle 45 to allow manipulation of container 22 by an individual. Handle 45 of container 22 is circular in cross section, and has a circular outer surface 45A that defines the outer diameter of handle 45. Ends 46 of handle 45 are conventionally rigidly and immovably affixed to, and held by, brackets 48 that extend from rear end 35 of body 30 near top 31. Ends 46 of handle 45 are also engaged by journals 50, on either side of brackets 48, extending from lid 40 so that lid 40 can be rotated relative to body 30 of container 22 between the lowered closed position of lid 40, shown in FIGS. 1 and 8, and the raised or upright open position of lid 40, shown in FIG. 7. Journals 50 rotate relative to handle 45, which does not rotate and is immovably held by brackets 48 according to a well-known design. To further aid in manipulation of container 22, a pair of wheels 52 are coupled to bottom 32 of container 22 adjacent to rear end 35 in a conventional manner, well known to those skilled in the art.

In accordance with the present invention, container 22 is fitted with a signaling assembly 21. In general, signaling assembly 21 includes a flag 60 and a coupling assembly 70 that joins container 22 and flag 60 to allow rotation of flag 60 between a lowered position over lid 40 in the closed position thereof, shown in FIG. 1, and a raised position, shown in FIG. 8, extending upright relative to lid 40 in the closed position thereof. According to the principle of the invention, there is a friction between coupling assembly 70 and container 22 that resists relative rotation between flag 60 and container 22. When container 22 is moved from an upright position to an inverted position, gravity automatically moves lid 40 from the closed position to the open position, and lid 40 acts on flag 60 positioned over lid 40 to overcome the friction between coupling assembly 70 and container 22 to rotate flag 60 from the lowered position to the raised position. When container 22 is subsequently returned from the inverted position to the upright position, gravity automatically moves lid 40 from the open position to the closed position. However, the friction between coupling assembly 70 and container 22 automatically holds flag 60 in the raised position. Gravity is insufficient to overcome the friction between coupling assembly 70 and container 22 to rotate flag 60 from the raised position to the lowered position. Only a force greater than gravity is required to overcome the friction between coupling assembly 70 and container 22 to rotate flag 60 from the raised position to the lowered position.

In a particular embodiment, coupling assembly 70 joins flag 60 and hinged connection 41 of container 22, to allow rotation of flag relative to hinged connection 41 between the lowered position over lid 40 in the closed position thereof, shown in FIG. 1, and the raised position, shown in FIG. 8. In this embodiment, the friction between signaling assembly 21 and container 22 is, more specifically, between coupling assembly 70 and hinged connection 41, and this friction resists relative rotation between flag 60 and hinged connection 41. When container 22 is moved from the upright position to the inverted position, gravity automatically moves lid 40 from the closed position to the open position, and lid 40 acts on flag 60 positioned over lid 40 to overcome the friction between coupling assembly 70 and hinged connection 41 to rotate flag 60 from the lowered position to the raised position relative to hinged connection 41. In this embodiment, when container 22 is subsequently returned from the inverted position to the upright position, gravity automatically moves lid 40 from the open position to the closed position, the friction between coupling assembly 70 and hinged connection 41 automatically holds flag 60 in the raised position, gravity is insufficient to overcome the friction between coupling assembly 70 and hinged connection 41 to rotate flag 60 from the raised position to the lowered position relative to hinged connection 41, and only a force greater than gravity is required to overcome the friction between coupling assembly 70 and hinged connection 41 to rotate flag 60 from the raised position to the lowered position relative to hinged connection 41. The part of hinged connection 41 that coupling assembly 70 is joined to is a handle, which is not only part of hinged connection 41 but is also a part of container 22, namely, the handle of container 22 useful by an individual to manipulate container 22.

Figure 2:
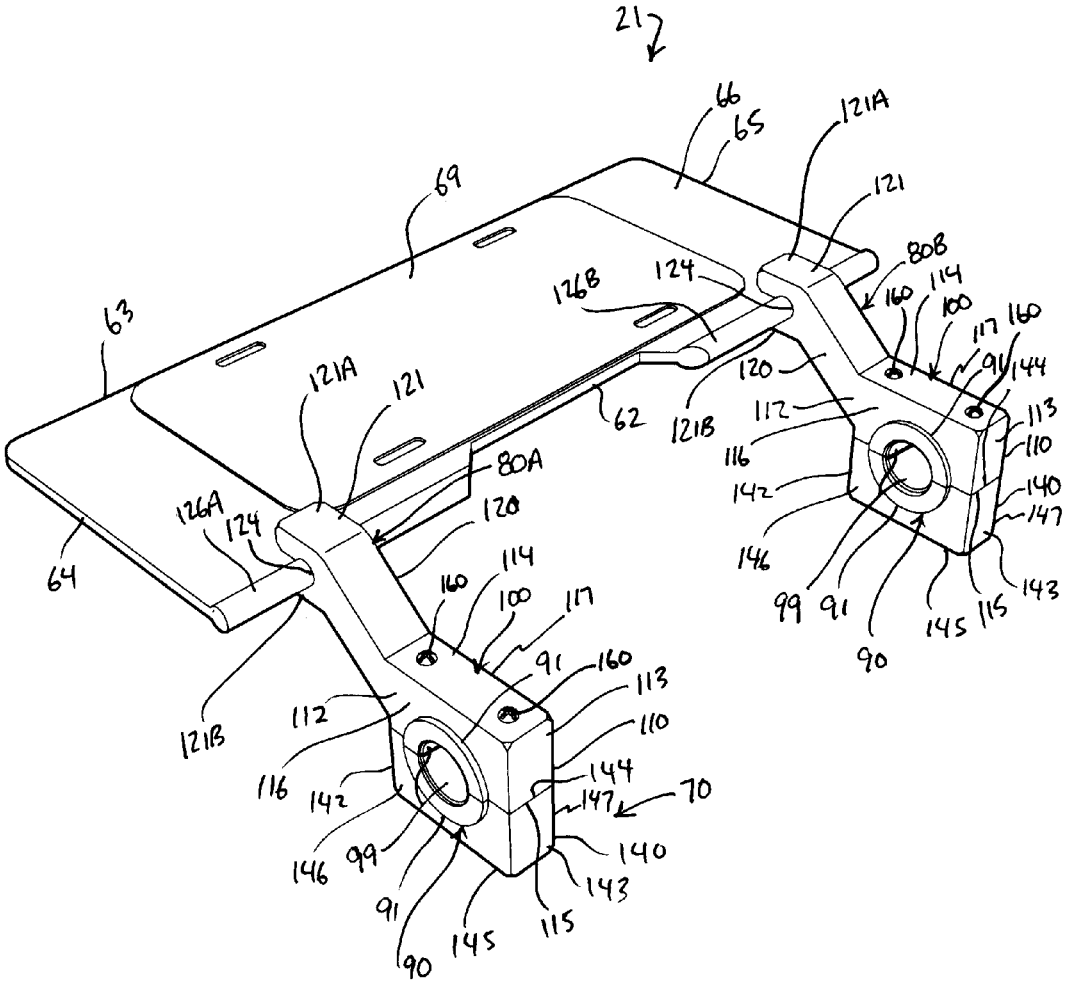
FIG. 2 is a perspective view of the signaling assembly of FIG. 1.
Figure 3:
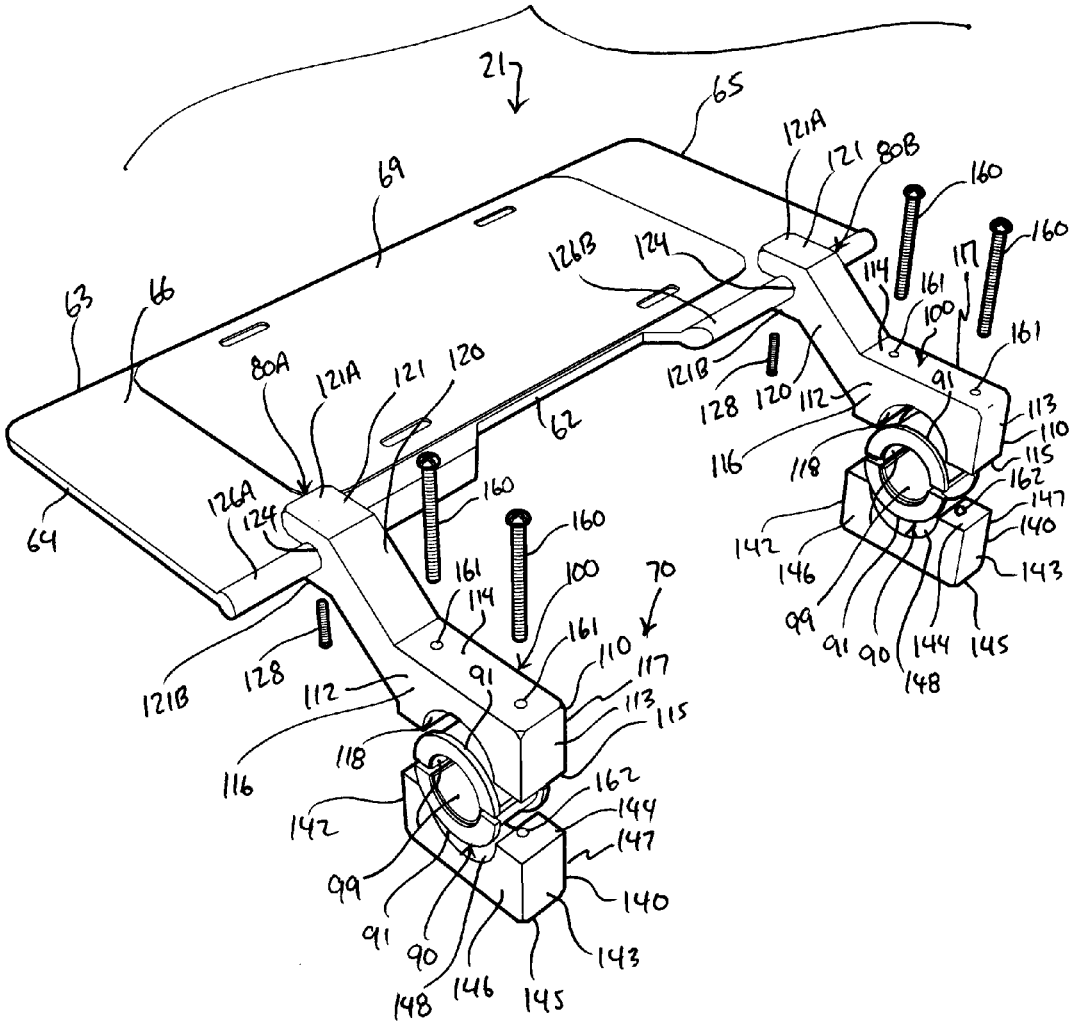
FIG. 3 is a partially exploded top perspective view of the embodiment of FIG. 3.

Referring now to FIGS. 2-3, signaling assembly 21 is operatively coupled with handle 45 of hinged connection 41. Coupling assembly 70 is used to join handle 45 of container 22 and flag 60. Flag 60 is fashioned of plastic, wood, aluminum or other metal, or other like or similar material or combination of materials having the inherent properties of rigidity, flexibility, resilience, and impact resistance, as is preferably integrally formed, such as by machining or molding. In an alternate embodiment, flag 60 can be formed of a plurality of parts, whether two or more, joined with fasteners, adhesive, welding, or other selected joinery. Flag 60 is a platen or sheet in the nature of a flat and generally rectangular-shaped body having opposed inner and outer ends 62 and 63, opposed sides 64 and 65, and opposed inner and outer surfaces or faces 66 and 67. Inner and outer ends 62 and 63 are the long ends of flag 60 and extend between sides 64 and 65, which are the short sides of flag 60. In this embodiment, a placard 69 used to post information useful to the owner or custodian of lidded container assembly 20 is attached to inner face 66, such as by a conventional adhesive, heat bonding, or the like. Mechanical fasteners, such as rivets or screws, can also be used to connect placard 69 to inner face 66 of flag 60. The useful information that may be applied to placard 69 can be, for example, a name, a number, a symbol, decorative indicia, entertainment indicia, sports indicia, celebrity likenesses, or the like as may be desired. The useful information on placard 69 can be applied via printing, one or more stickers, etc. If desired, the useful information can be applied directly to inner face 66. Outer face 67 may be similarly fashioned with useful information like that of inner face 66 if so desired. A placard like that of placard 69 can be similarly applied to outer face 67 in an alternate embodiment.

Coupling assembly 70 extends from flag 60, and is made up of couplers 80A and 80B that join flag 60 and handle 45 of hinged connection 41. Couplers 80A and 80B extend from inner end 62 of flag 60. Couplers 80A and 80B are spaced apart, are diametrically opposed from one another, and are parallel relative to each other. Coupler 80A is located adjacent to side edge 64, and coupler 80B is located adjacent to side 65.

There are two couplers 80A and 80B in the present embodiment, and they are identical to each other in each and every respect. Accordingly, the details of coupler 80A are discussed below, with the understanding that the ensuing discussion of coupler 80A applies equally to coupler 80B. For reference purposes, the reference characters used below in the description of coupler 80A are also incorporated with coupler 80B throughout the various drawing views.

Coupler 80A includes two main components, namely, a split collar 90, and a clamp assembly 100. As shown in FIGS. 1, 7, and 8, split collar 90 engages handle 45, and clamp assembly 100 joins split collar 90 and flag 60. The assembly of split collar 90 and clamp assembly 100 is a bearing assembly that allows rotation of flag 60 relative to handle 45 of hinged connection 41 between its lowered and raised positions.

Split collar 90 is a multiple-piece design. In this embodiment, split collar 90 is made of two collar segments 91 each fashioned of plastic, wood, aluminum or other metal, or other like or similar material or combination of materials having the inherent properties of rigidity, flexibility, resilience, and impact resistance, as is preferably integrally formed, such as by machining or molding. In an alternate embodiment, collar segments 91 can be formed of a plurality of parts, whether two or more, joined with fasteners, adhesive, welding, or other selected joinery.

Figure 4:
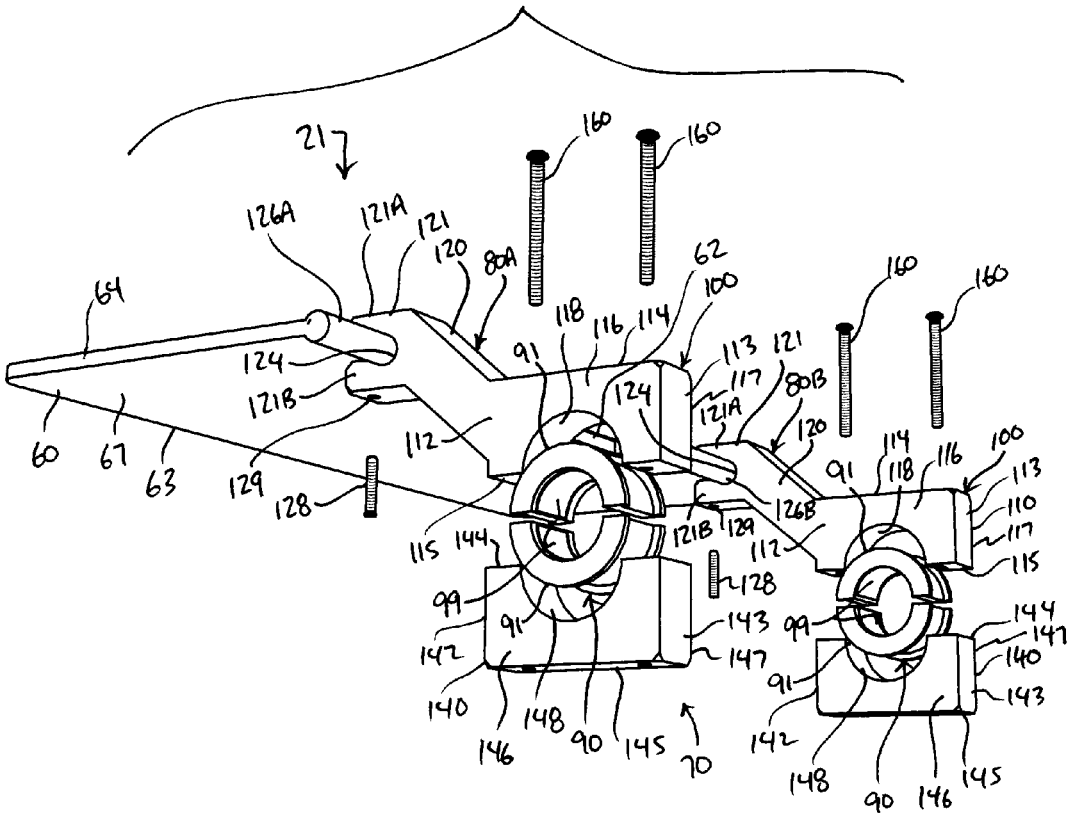
FIG. 4 is a partially exploded bottom perspective view of the embodiment of FIG. 3.
Figure 4A:
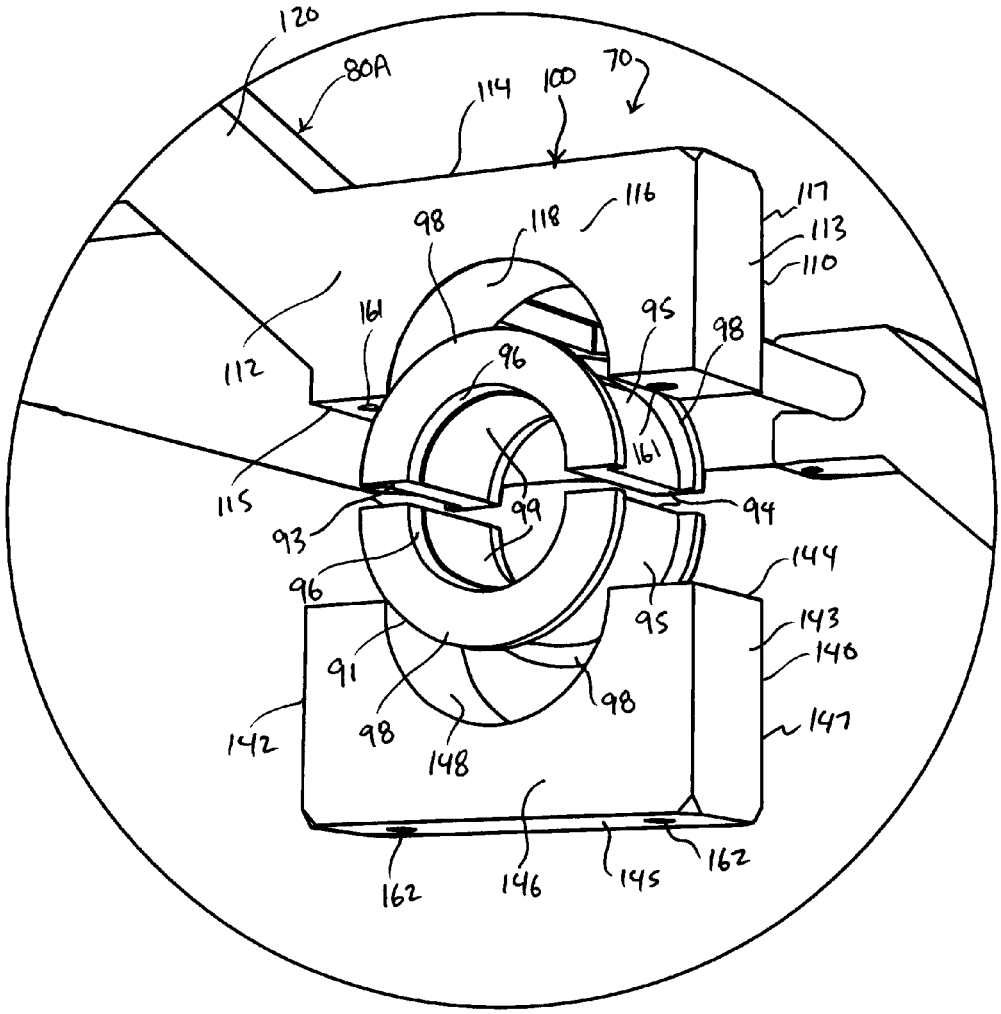
FIG. 4A is an enlarged, exploded perspective view of a clamp assembly and a split collar of a coupler of the signaling assembly of FIG. 1.

Collar segments 91 are identical in size and in shape and otherwise in every respect. Looking to FIGS. 4 and 4A, each collar segment 91 includes a half cylinder 92. Half cylinder 92, which is a half cylinder wall, has opposed ends 93 and 94, a half-cylindrical outer surface 95 that extends from end 93 to end 94 between the opposed sides of half cylinder 92, and a half-cylindrical inner surface 96 that extends from end 93 to end 94 between the opposed sides of half cylinder 92. Opposed half flanges or rims 98 at the opposed sides of half cylinder 92 extend vertically outward from half-cylindrical outer surface 95, and extend from end 93 to end 94. A piece of readily-available double-sided foam adhesive tape 99 is adhesively adhered on half-cylindrical inner surface 96. Tape 99 extends along half-cylindrical inner surface 96 between the sides of half cylinder 92 from end 93 of half cylinder 92 to end 94 of half cylinder 92. Half-cylindrical inner surface 96 relates to circular outer surface 45A of handle 45. Tape 99 is inherently flexible and yielding, allowing it to flexibly conform to the curved or curvilinear surface that characterizes half-cylindrical inner surface 96. As such, when tape 99 is adhered to half-cylindrical inner surface 96, tape 99 and half-cylindrical inner surface 96 concurrently relate to circular outer surface 45A of handle 45.

Figure 5:
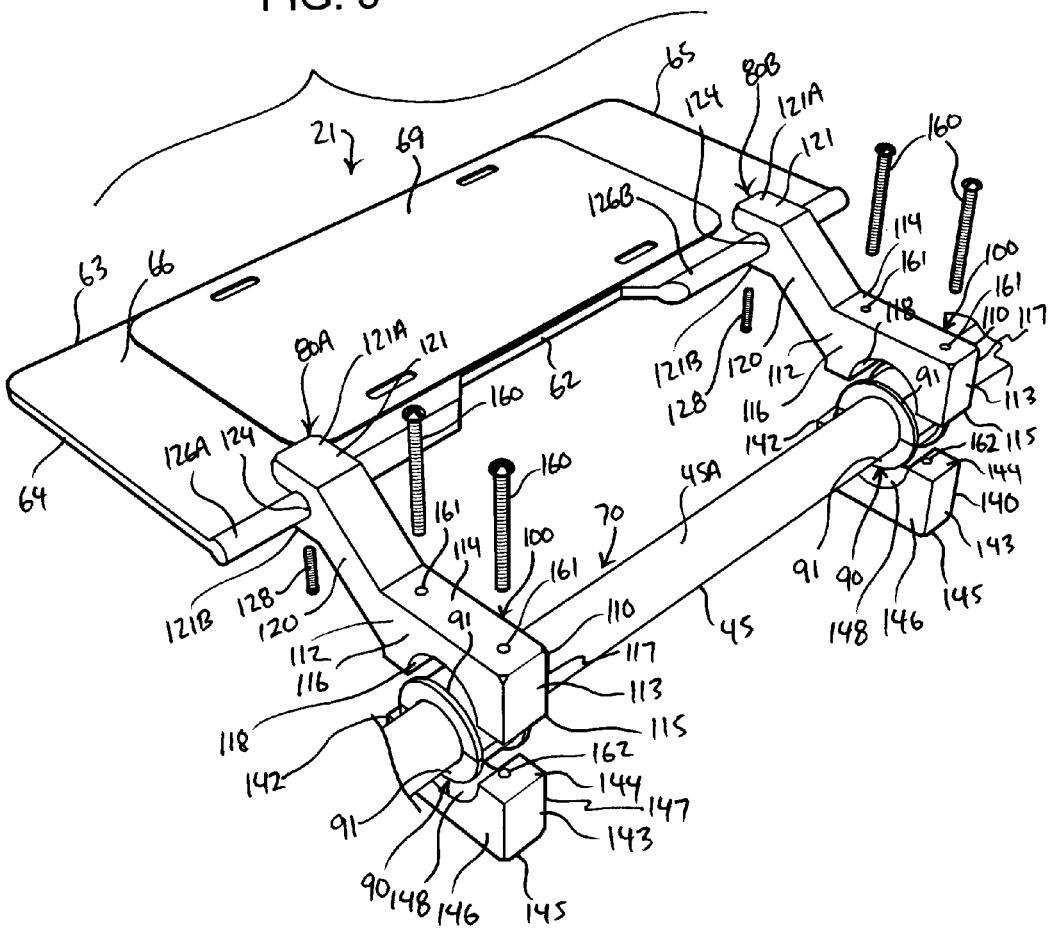
FIG. 5 is an enlarged perspective view like that of FIG. 3 illustrating the signaling assembly as it would appear partially installed on a handle.

Split collar 90 is installed on handle 45, engages handle 45, extends around handle 45, is coupled so as to be arrested from rotation about handle 45, and is installed on handle 45 without having to disassembly or modify handle 45 and hinged connection 41. In regards to the installation of split collar 90 on handle 45 in reference to FIG. 6, collar segments 91 are diametrically opposed on either side of handle 45. Tape 99 on half-cylindrical inner surface 96 of each collar segment 91 faces circular outer surface 45A of handle 45 and the respective ends 93 and 94 of collar segments 91 aligned so as to diametrically oppose one another on either side of handle 45. Collar segments 91 are applied toward one another so as to bring tape 99 of the respective collar segments 91 into direct contact against circular outer surface 45A of handle 45. This adhesively adheres collar segments 91 to circular outer surface 45A of handle 45. In this adhesive installation of split collar 90 on circular outer surface 45A of handle 45 via tapes 99 of the respective collar segments 91, split collar 90 is adhesively adhered on circular outer surface 45A of handle 45 so as to be arrested from rotating about handle 45. Split collar 90 extends around, or otherwise circumscribes, a section of handle 45 like a collar. Ends 93 of collar segments 91 are diametrically juxtaposed on one side of handle 45, and ends 94 of collar segments 91 are diametrically juxtaposed on the opposed side of handle 45. Inwardly-facing half-cylindrical inner surfaces 96 and the tape 99 they each have are circumferentially aligned and extend around or otherwise circumscribe the given section of circular outer surface 45A of handle 45. Outwardly-facing half-cylindrical outer surfaces 95 are circumferentially aligned and extend around or otherwise circumscribe the given section of circular outer surface 45A of handle 45. The circumferential aligned outwardly-facing half-cylindrical outer surfaces 95 cooperate to define a circular perimeter, or perimeter surface area, of the installed split collar 90 used to join clamp assembly 100. Rims 98 on each side of collar segments 91 are circumferentially aligned and extend around or otherwise circumscribe the given section circular outer surface 45A of handle 45 like a circular flange projecting circumferentially outward from half-cylinder outer surfaces 95 on either side of collar segments 91. FIG. 5 shows split collars 90 of couplers 80A and 80B so installed on circular outer surface 45A of handle 45 in preparation joining the respective clamp assemblies 100 to join split collars 90 on handle 45 to flag 60 so as to join flag 60 to handle 45 of hinged connection 41 of container 22. To de-unite or decouple split collar 90 from handle 45, one need only pull collar segments 91 apart from handle. While this may result in the damage or destruction of tape 99, it will not result in damage or destruction of collar segments 91 or handle 45. Tape 99 may have to be replaced, and this is to be expected. However, any tape residue on handle 45 or collar segments 91 may be removed in any conventional manner, such as with a mild soap or a solvent with the aid of a towel, such as a paper towel or a cloth towel.

As shown in FIGS. 1, 7, and 8, split collars 90 engage handle 45 as discussed in detail above. Split collars 90 are engaged to circular outer surface 45A of handle 45 between brackets 48. Split collar 90 of coupler 80A is located adjacent to one bracket 48, and the other split collar 90 of coupler 80B is located adjacent to the other bracket 48. Clamp assemblies 100 of couplers 80A and 80B join flag 60 to the respective split collars 90. Clamp assembly 100 of coupler 80A will now be discussed. Because couplers 80A and 80B are identical, again it is to be understood that the ensuing discussion of clamp assembly 100 in connection with coupler 80A applies equally to clamp assembly 100 of coupler 80B.

Referencing FIGS. 2, 3, 4, 4A, 5, and 6, in relevant part, clamp assembly 100 of coupler 80A is a multiple-piece design. In this embodiment, clamp assembly 100 is made up of two clamp bodies, blocks, or parts 110 and 140 each made of plastic, wood, aluminum or other metal, or other like or similar material or combination of materials having the inherent properties of rigidity, flexibility, resilience, and impact resistance, as is preferably integrally formed, such as by machining or molding. In an alternate embodiment, clamp bodies or parts 110 and 140 can be formed of a plurality of parts, whether two or more, joined with fasteners, adhesive, welding, or other selected joinery.

Clamp part 110 has inner end 112, outer end 113, upper end 114, lower end 115, opposed sides 116 and 117, and a half-cylindrical inner surface 118 in lower end 115 that extends from inner end 112 to outer end 113 between opposed sides 116 and 117. Half-cylindrical inner surface 118 relates to half-cylindrical outer surface 95 of each collar segment 91. An extension of inner end 112 of body 110 in the form of arm 120 extends from inner end 112 of body 110 to an outer extremity 121. Outer extremity 121 is used to engage and connect flag 60. Clamp part 140 has inner end 142, outer end 143, upper end 144, lower end 145, opposed sides 146 and 147, and a half-cylindrical inner surface 148 in upper end 144 that extends from inner end 142 to outer end 143 between opposed sides 146 and 147. Like half-cylindrical inner surface 118 of clamp part 110, half-cylindrical inner surface 148 relates to half-cylindrical outer surface 95 of each collar segment 91. Half-cylindrical inner surfaces 118 and 148 are identical in every respect.

In reference to coupler 80A, clamp assembly 100 engages split collar 90. In the installation of clamp assembly 100 on split collar 90 in reference to FIG. 6, clamp parts 110 and 140 are diametrically opposed on either side of split collar 90 adhered to handle 45. In this example, half-cylindrical inner surface 118 in lower end 115 of clamp part 110 faces half-cylindrical outer surface 95 of one collar segment 91, and identically the half-cylindrical inner surface 148 in upper end 144 of clamp part 140 faces half-cylindrical outer surface 95 of the other collar segment 91. Inner ends 112 and 142 of the respective clamp parts 110 and 140 are aligned so as to diametrically oppose one another on either side of split collar 90, and outer ends 113 and 143 of the respective clamp parts 110 and 140 are aligned so as to diametrically oppose one another on either side of split collar 90. Clamp segments 110 and 140 are applied inwardly toward one another on either side of split collar 90 so as to bring lower end 115 and upper end 144 of the respective clamp parts 110 and 140 between the rims 98 of the respective collar segments 91, and to bring half-cylindrical inner surfaces 118 and 148 of the respective clamp parts 110 and 140 into direct contact against the half-cylindrical outer surfaces 95 of the respective collar segments 91. Clamp parts 110 and 140 are then releasably connected together so as to frictionally engage half-cylindrical inner surfaces 118 and 148 against the half-cylindrical outer surfaces 95 of the respective collar segments 91 so as to, in turn, frictionally engage/join clamp assembly 100 and split collar 90. Half-cylindrical inner surfaces 118 and 148 circumferentially relate to circumferentially aligned half-cylindrical outer surfaces 95 of collar segments 91 of split collar 90. In other words, half-cylindrical inner surfaces 118 and 148 relate to the circular perimeter, or perimeter surface area, of the installed split collar 90 on which clamp assembly 100 is installed. Rims 98 of the respective collar segments 91 of split collar 90 are positioned along the respective sides 116 and 117 of clamp part 110 and the respective sides 146 and 147 of clamp part 140 and form opposed circular flanges of the installed split collar 90 that capture clamp parts 110 and 140 therebetween so as to restrain lateral or side-to-side displacement of clamp assembly 100 and prevent clamp assembly 100 from falling off split collar 90.

In this embodiment, clamp parts 110 and 140 are releasably connected together with threaded fasteners 160, in the form of threaded bolts, which allows clamp parts 110 and 140 to be non-destructively de-united or decoupled. Threaded fasteners 160 are applied through bolt holes 161 through the respective inner and outer ends 112 and 113 of clamp part 110 on either side of split collar 90. Threaded fasteners 160 are then threaded into corresponding bolt holes 162 through the respective inner and outer ends 142 and 143 of clamp part 140 on either side of split collar 90. Threaded fasteners 160 are then tightened via rotation forcing clamp parts 110 and 140 together clamping down upon split collar 90 so as to frictionally engage/join half-cylindrical inner surfaces 118 and 148 of clamp parts 110 and 140 with the half-cylindrical outer surfaces 95 of the respective collar segments 91. To non-destructively de-unite or decouple clamp parts 110 and 140, the foregoing operation of releasably connecting clamp parts 110 and 140 with threaded fasteners 160 need only be reversed.

According to the described installation of clamp parts 110 and 140 of clamp assembly 100 on split collar 90, clamp parts 110 and 140 of clamp assembly 100 extend around, or otherwise circumscribe, half-cylindrical outer surfaces 95 of collar segments 91 of split collar 90. Inner ends 112 and 142 of clamp parts 110 and 140 are diametrically juxtaposed on one side of handle 45 and split collar 90. Outer ends 113 and 143 of clamp parts 110 and 140 are diametrically juxtaposed on the opposed side of handle 45 and split collar 90. Half-cylindrical inner surfaces 118 and 148 of clamp parts 110 and 140 are circumferentially aligned and extend around or otherwise circumscribe half-cylindrical outer surfaces 95 of collar segments 91 of split collar 90.

Figure 6:
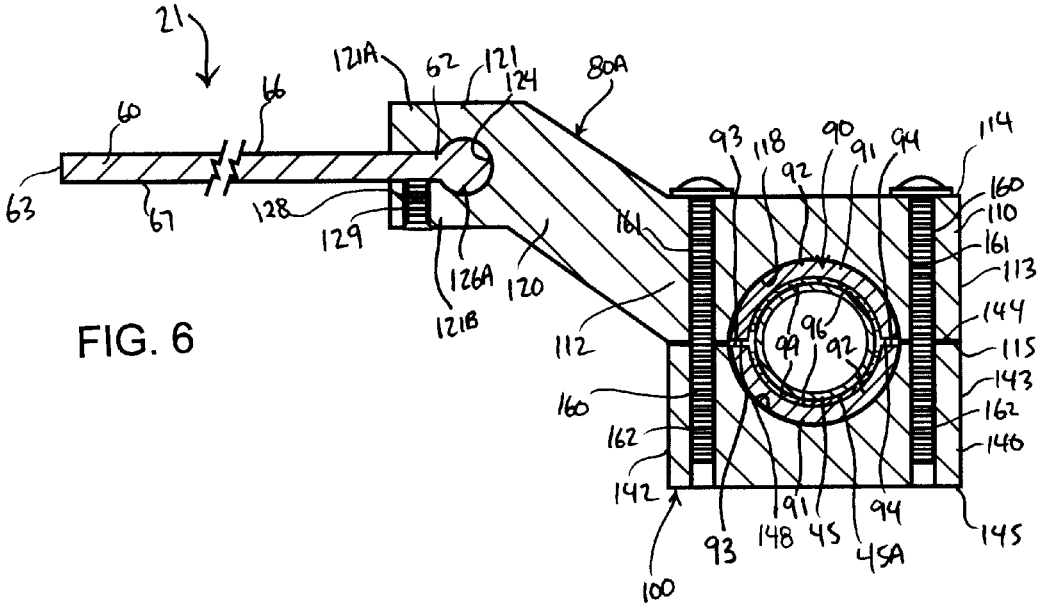
FIG. 6 is a section view taken along line 6-6 of FIG. 1.

As shown in FIGS. 2-6, an extension of inner end 112 of body 110 of coupler 80A, in the form of arm 120, extends from inner end 112 of body 110 and terminates with an outer extremity 121, which is joined to flag 60. Outer extremity 121 is engaged to flag 60. Outer extremity 121 of arm 120 is engaged to inner end 62 of flag 60 in this embodiment, which joins flag 60 to clamp assembly 100 clamped on split collar 90 adhered to handle 45. In this embodiment, outer extremity 121 of arm 120 is releasably connected/joined to inner end 62 of flag 60 with an engagement assembly in the form of a tongue and groove assembly. In this embodiment, outer extremity 121 of arm 120 is a bifurcation, in that outer extremity 121 is forked or divided into two parts or branches 121A and 121B forming a groove 124 therebetween that relates to and that receives a corresponding tongue 126A in inner end 62 of flag 60. As it relates to coupler 80A, tongue 126A is a circular, elongate bead that extends inwardly from side 64 of flag 60 along inner end 62 toward, but not reaching, the middle or midsection of flag 60. Groove 124 has a complementing beaded shape that corresponds to bead shape of tongue 126A. As such, the tongue-and-groove assembly herein disclosed, which is exemplary of a male-and-female engagement pair, is a beaded tongue-and-groove assembly. Tongue 126A is applied into groove 124, the two parts fitting closely together, forming the tongue-and-groove engagement, engaging branches 121A and 121B along inner and outer faces 66 and 67 of flag 60. Tongue 126A and groove 124 are slid together from either end of tongue 126A, or snapped together, and either technique may be used. Tongue 126A and groove 124 are joined at an intermediate position along the length of tongue 126A adjacent to side 64 of flag 60 and this corresponds to the resulting location of clamp assembly 100. Outer extremity 121 is then releasably secured to flag 60 with set screw 128 shown in FIGS. 3, 4, 5, and 6. As seen in FIG. 6, set screw 128 is threaded into a threaded opening 129 (shown also in FIG. 4) through branch 121B of outer extremity 121 of arm 120 so that the end point of set screw 128 bears firmly against outer face 67 of flag 60. To non-destructively de-unite or decouple outer extremity 121 from flag 60, set screw 128 need only be released and tongue 126A and groove 124 slid apart from one another.

Flag 60 has two tongues, namely, tongue 126A discussed above that relates to coupler 80A, and an identical tongue 126B that relates to coupler 80B. Tongue 126B extends inwardly from side 65 of flag 60 along inner end 62 toward, but not reaching, the middle or midsection of flag 60, and the coupler 80B is joined to tongue 126B in precisely the same way as described above in conjunction with tongue 126A and coupler 80A.

The installed signaling assembly 21 is located between lid 40 and rear end 35 of container 22, and couplers 80A and 80B of coupling assembly 70 join hinged connection 41 and flag 60, as is clearly shown in FIGS. 1, 7, and 8. With additional reference to FIG. 6, the friction between signaling assembly 21 and container 22, which is provided by the bearing assembly of the respectively couplers 80A and 80B, and more specifically between, on the one hand, half-cylindrical inner surfaces 118 and 148 of clamp assembly 100, and, on the other hand, half-cylindrical outer surfaces 95 of collar segments 91 of split collar 90, resists relative rotation between clamp assembly 100 and split collar 90 and holds clamp assembly 100, and thus flag 60, stationary relative to collar segments 91 of clamp assembly 100. This described friction is facilitated by the tightening of threaded fasteners 160 that forces clamp parts 110 and 140 together clamping down upon split collar 90 so as to frictionally engage/join half-cylindrical inner surfaces 118 and 148 of clamp parts 110 and 140 with the half-cylindrical outer surfaces 95 of the respective collar segments 91 as described above. This friction can be overcome to allow rotation between clamp assembly 100 and split collar 90. When the friction is not overcome, the friction holds signaling assembly in a fixed position at any position of flag 60 whether in the lowered position of flag 60 as in FIG. 1, the raised position of flag as shown in FIGS. 7 and 8, and at any position therebetween. When this friction is overcome, clamp assembly 100 can be made to rotate about collar segments 91 of split collar 90 for, in turn, rotating flag 60 between its lowered position, shown in FIG. 1, and its raised position, shown in FIGS. 7 and 8. During the rotation of clamp assembly 100 relative to split collar 90 when the friction holding clamp assembly 100 to split collar 90 is overcome, half-cylindrical inner surfaces 118 and 148 of clamp assembly 100, while still frictionally engage half-cylindrical outer surfaces 95 of collar segments 91 of split collar 90, slip or otherwise slide across one another. The circumferential relationship between, on the one hand, the circumferentially-aligned half-cylindrical inner surfaces 118 and 148 of clamp assembly 100, and, on the other hand, half-cylindrical outer surfaces 95 of collar segments 91 of split collar 90, allows clamp assembly 100 to be rotated relative to split collar 90 for rotating flag 60 between its lowered and raised positions. The adherence of collar segments 91 of split collar 90 on circular outer surface 45A of handle 45 with the double-sided adhesive tape as described in detail above is sufficient to arrest collar segments 91 from rotating relative to handle 45 in response to the rotation of clamp assembly 100 relative to collar segments 91 of split collar 90. In the absence of an applied force sufficient to overcome the described friction between clamp assembly 100 and split collar 90, the described friction takes hold between clamp assembly 100 and split collar 90 so as to resist relative rotation between clamp assembly 100 and split collar 90 so as to hold clamp assembly 100, and thus flag 60, stationary with respect to clamp assembly 100.

In sum, coupling assembly 70 joins handle 45 of hinged connection 41 and flag 60 to allow rotation, at the connections between clamp assemblies 100 and split collars 90 on handle 45, of flag 60 relative to handle 45 of hinged connection 41 between the lowered position of flag over lid 40 in the closed position of lid 40, shown in FIG. 1, and the raised position of flag 60, shown in FIG. 8. The described friction between signaling assembly 21 and container 22, which is between, on the one hand, clamp assemblies 100 and, on the other hand split collars 90 on handle 45 of hinged connection 41, is characterized in that it resists relative rotation between flag 60 and container 22 and, more particularly, between flag 60 and hinged connection 41 and, still more particularly, between flag 60 and handle 45 of hinged connection 41 of container. When container 22 is moved from the upright position to the inverted position, gravity automatically moves lid 40 from the closed position, shown in FIG. 1, to the open position, shown in FIG. 7, and lid 40 acts on flag 60 positioned over lid 40 to overcome the friction to rotate flag 60 at the connections between clamp assemblies 100 and split collars 90 from the lowered position of flag 60 to the raised position of flag 60. When container 22 is subsequently returned from the inverted position to the upright position, gravity automatically moves lid 40 from the open position to the closed position, the friction between signaling assembly 21 and container 22 automatically holds flag 60 in the raised position, gravity is insufficient to overcome the friction between signaling assembly 21 and container 22 to rotate flag 60 from the raised position to the lowered position relative to hinged connection 41, and only a force greater than gravity is required to overcome the friction between signaling assembly 21 and container 22 to rotate flag 60 from the raised position to the lowered position relative to hinged connection 41.

Operation of lidded container assembly 20 will now be described in conjunction with FIGS. 9-15. Container 22 is initially stationed at a given location for refuse collection by a refuse collection vehicle. Container 22 is set on the ground and extends upright from bottom 32 to top 31, lid 40 is closed enclosing the deposited items within container 22, and flag 60 is set by the owner or custodian, such as by hand, in the lowered position lying over lid 40, with inner face 66 of flag 60 facing upwardly and outer face 67 of flag 60 facing downwardly toward lid 40. To rotate flag 60 between its lowered and raised positions, a user need only take up flag 60 by hand and apply a pushing or pulling force, such as on the order of 4-6 pounds, against flag 60 sufficient to overcome the friction between signaling assembly 21 and container 22 to rotate flag to the lowered position or to the raised position.

Figure 9:
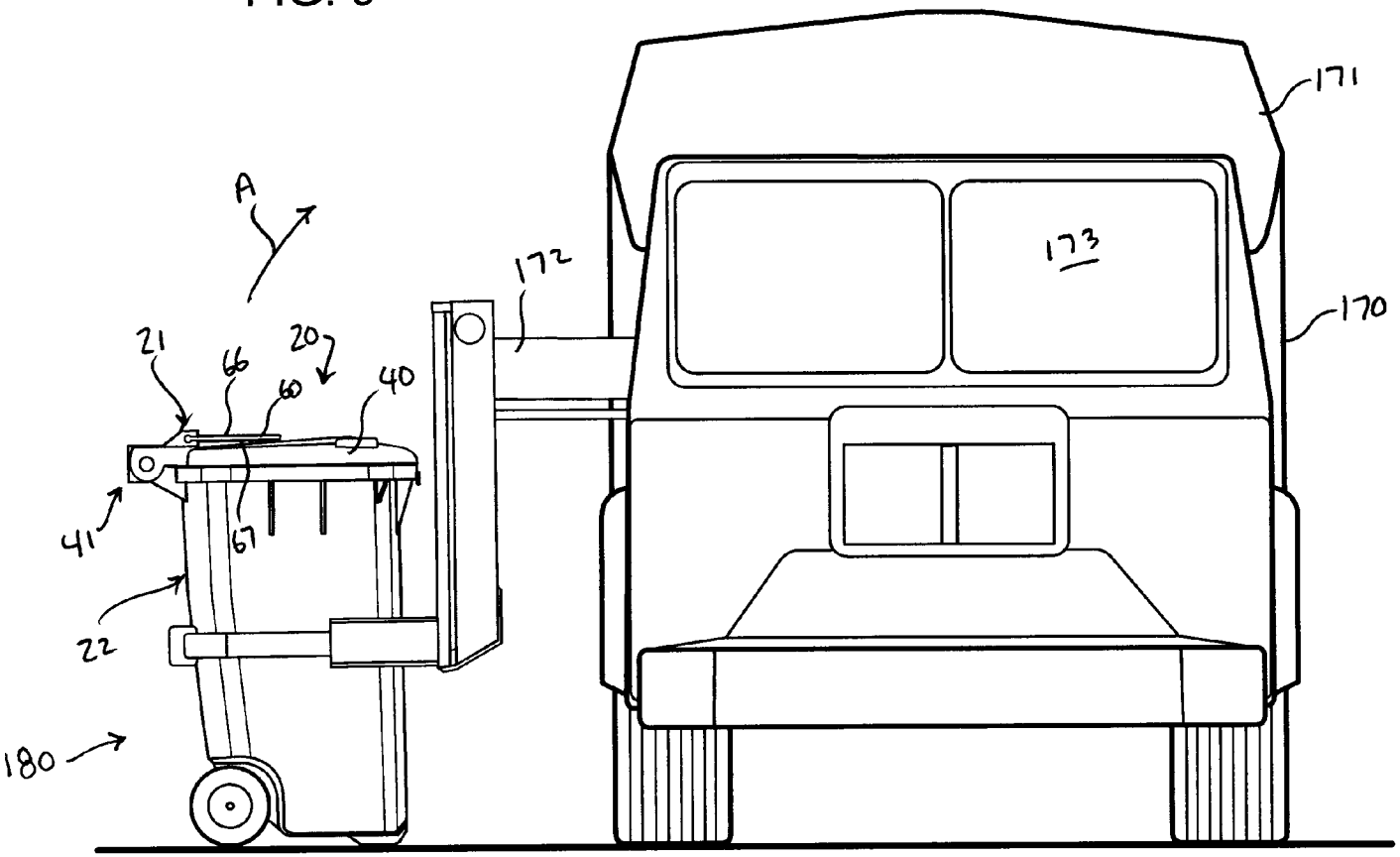
FIGS. 9-11, FIG. 11A, and FIGS. 12-15 are sequential, schematic views showing the emptying of the lidded container by a collection vehicle and the corresponding operation of the signaling assembly.
Figure 10:
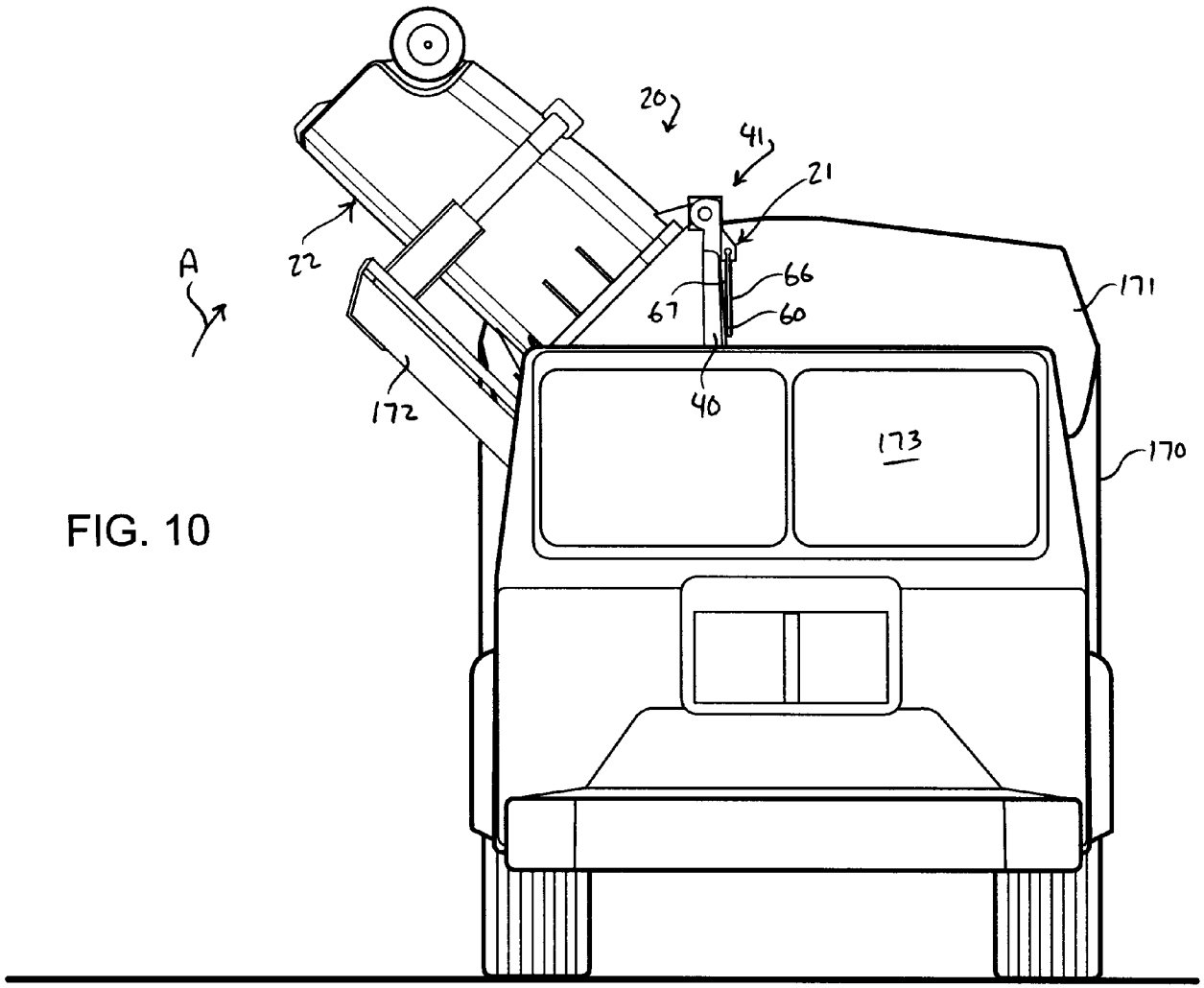
Figure 11:
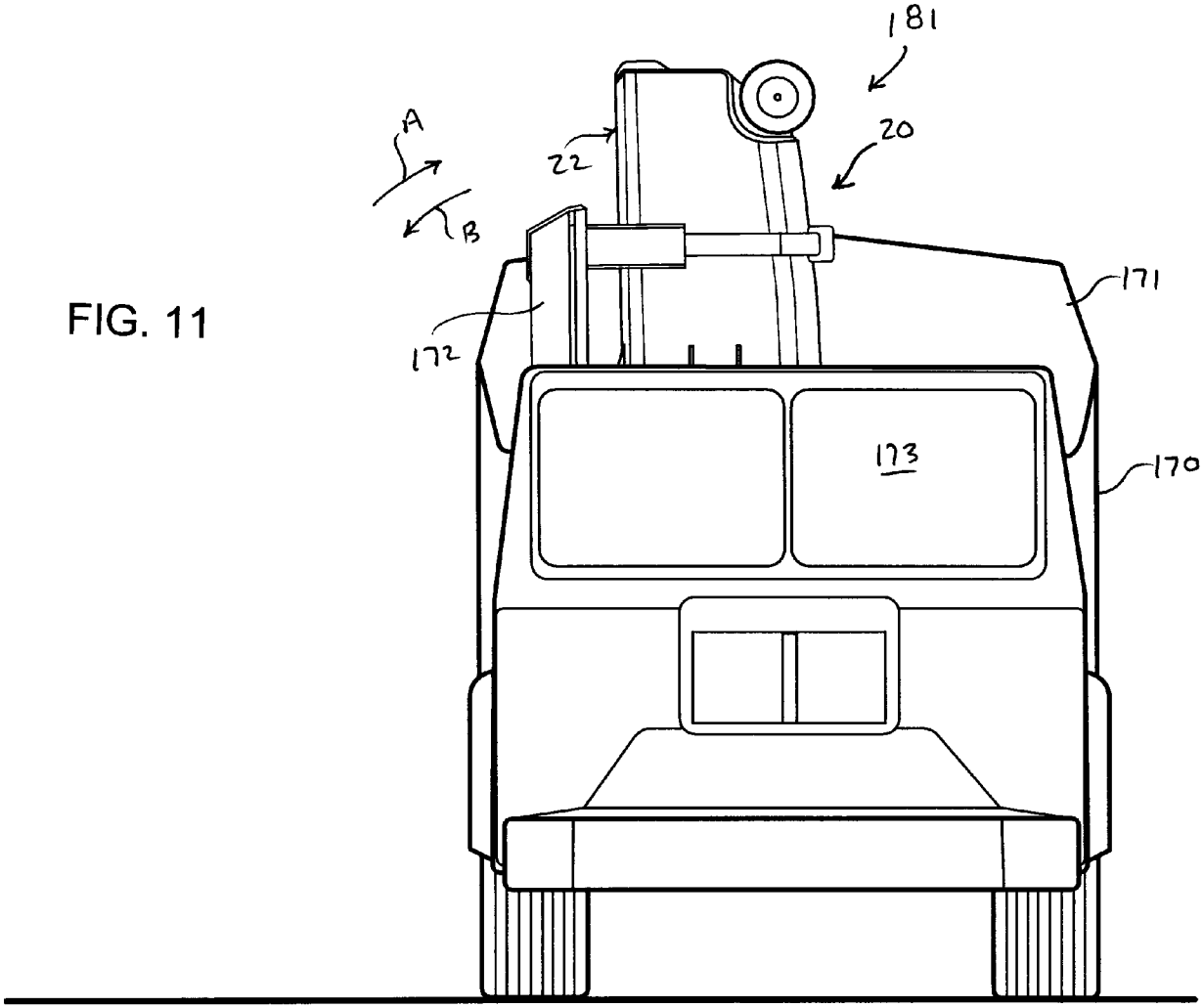
Figure 11A:
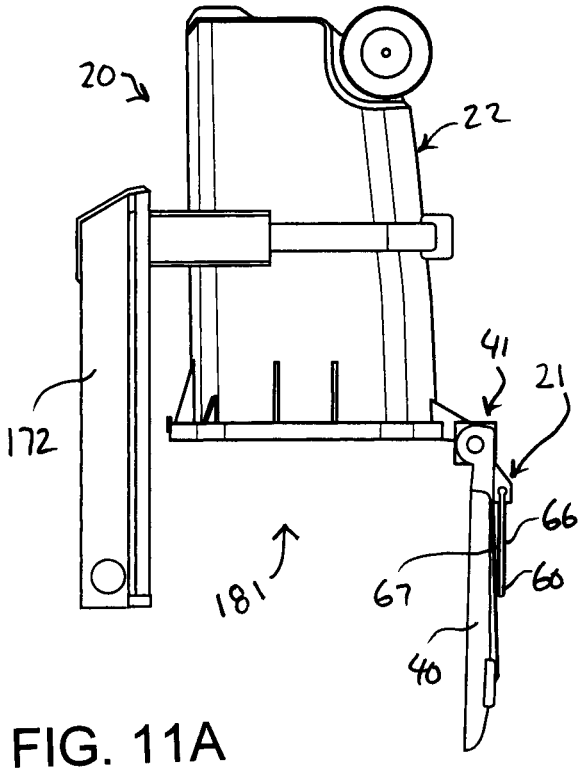

Container 22 in an upright position with lid 40 in the closed position and flag 60 in the lowered position over lid 40 in preparation for emptying container 22 of its contents. In the lowered position of flag 60 over lid 40 in the closed position thereof, the friction of signaling assembly 21 that resists rotation of flag 60 allows flag 60 to assist in preventing lid 40 from blowing open, such as from a strong wind. Let it be assumed that the collection vehicle is a truck 170 having hopper 171 for receiving refuse, and lifting mechanism 172 for remotely engaging a container and for lifting the engaged container atilt/inverted over hopper 171 to discharge the contents of container 22 into hopper 171. Initially, the operator of truck 170 will position truck 170 along the front or curb end 34 of container 22 so that lifting mechanism 172 can conventionally engage container 22 to be emptied, as is shown in FIG. 9. Lifting mechanism 172 is then activated by the operator remotely, from cab 173 of truck 170, to lift the engaged container 22 to hopper 171, moving container 22 along path A, referenced in FIGS. 9-11, from the lowered upright position 180 in FIG. 9 to the raised inverted emptying position 181 in FIG. 11A automatically rotating lid 40 from the closed position in FIG. 9 to the open position in FIG. 11 extending downwardly under the influence of, or otherwise responsive to, gravity, and throughout this movement there is a concurrent action of lid 40 acting on outer face 67 of flag 60 overcoming the friction between signaling assembly 21 and container 22 automatically rotating flag 60 from the lowered position in FIG. 9 to the raised position in FIG. 11A responsive to rotation of lid 40 from the closed position in FIG. 9 to the open position in FIG. 11. As container 22 is moved along path A from upright position 180 in FIG. 9 to raised inverted emptying position 181 in FIG. 11 and FIG. 11A and lid 40 automatically moves under the force of gravity from its closed position in FIG. 9 to its open position in FIG. 11 and FIG. 11A, the inherent weight of lid 40, which is a nominal 5-7 pounds, acts on outer face 67 of flag 60 with a force greater than gravity, here in this example on the order of approximately 4-6 pounds, thereby resulting in the concurrent rotation of flag 60 from its lowered position in FIG. 9 to its raised position in FIG. 11A. FIG. 10 shows container 22 as it would appear raised by lifting mechanism 172 to an intermediate position between lowered upright position 180 in FIG. 9 and raised inverted emptying position 181 in FIG. 11.

Figure 12:
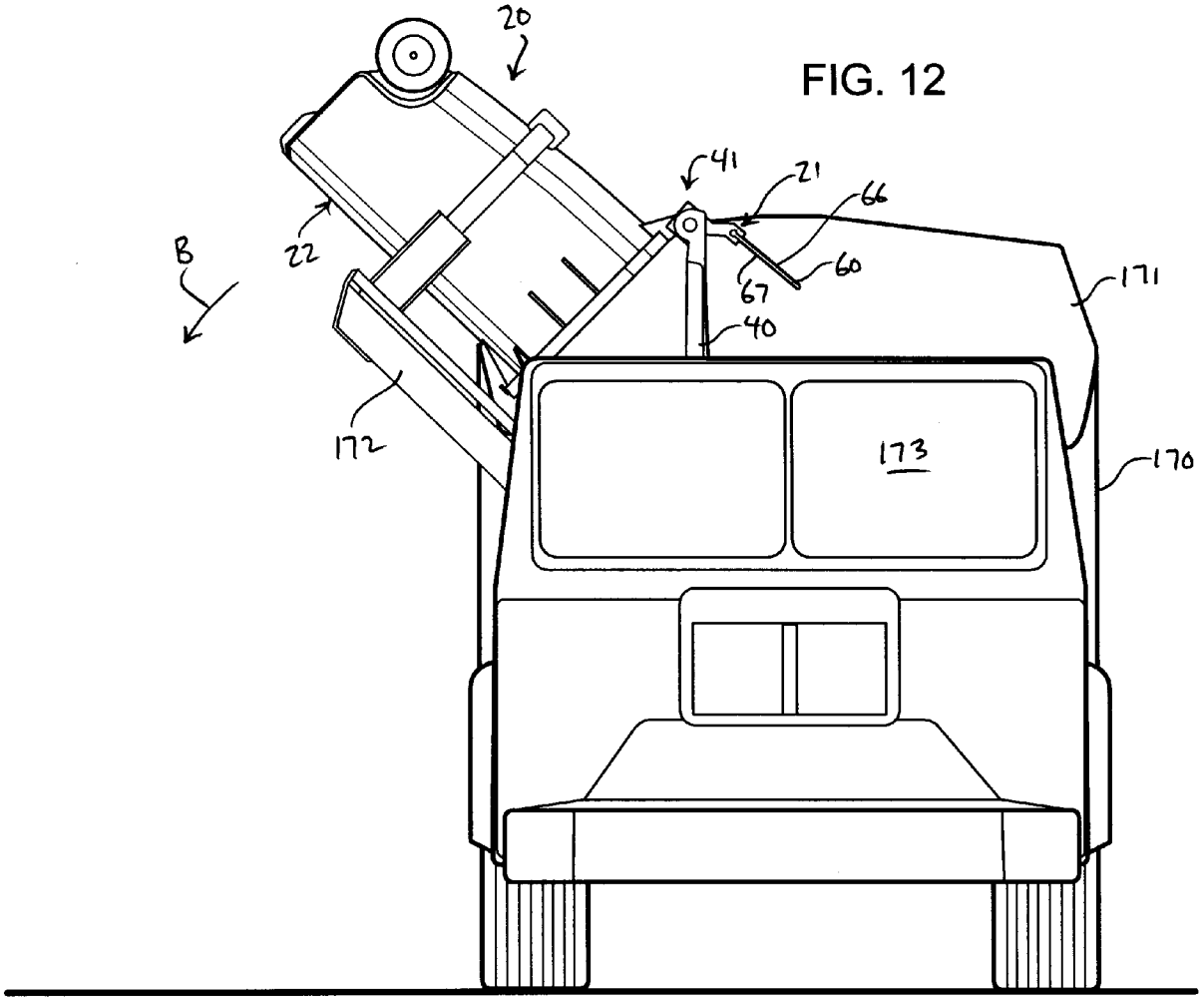
Figure 13:
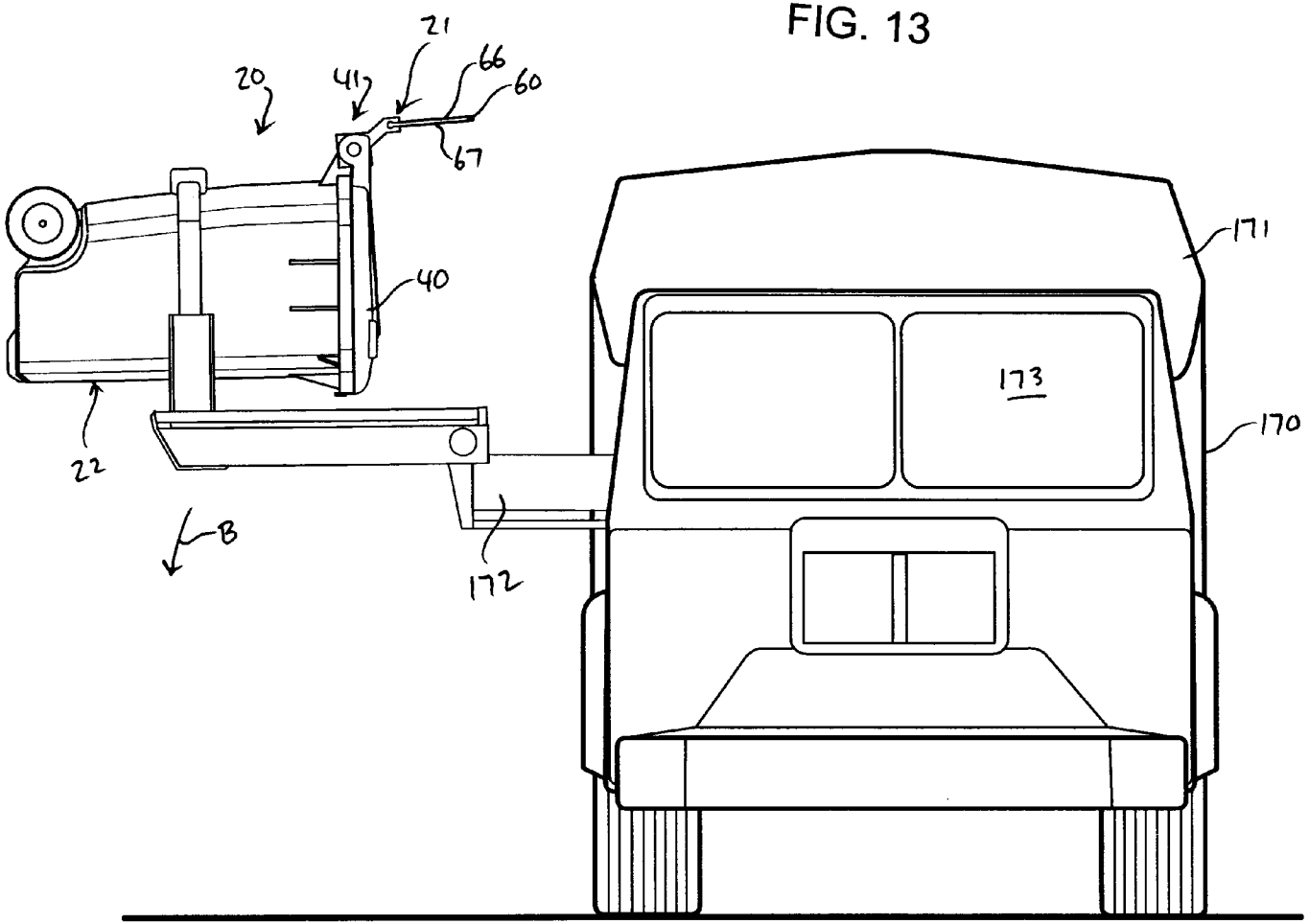
Figure 14:
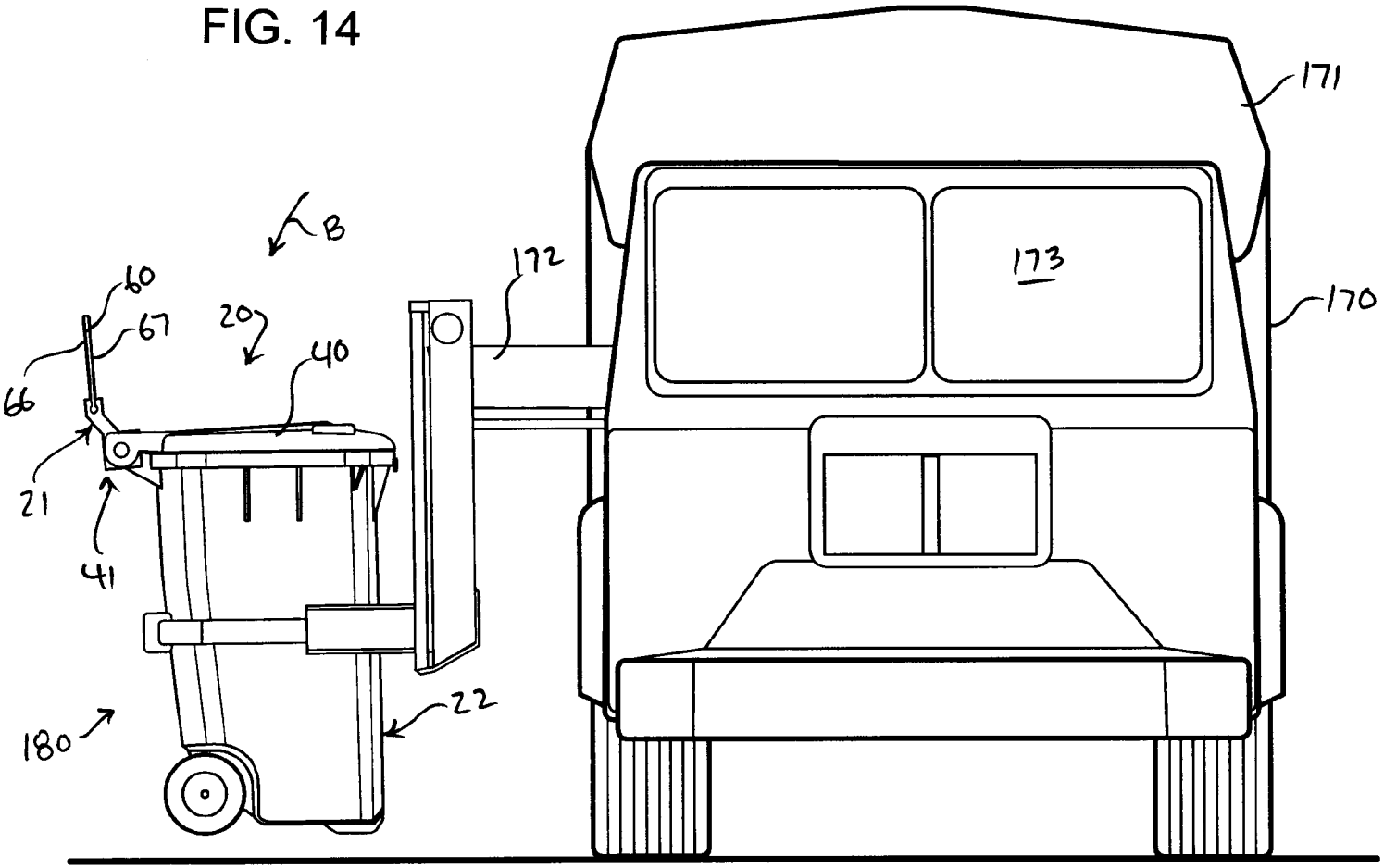
Figure 15:
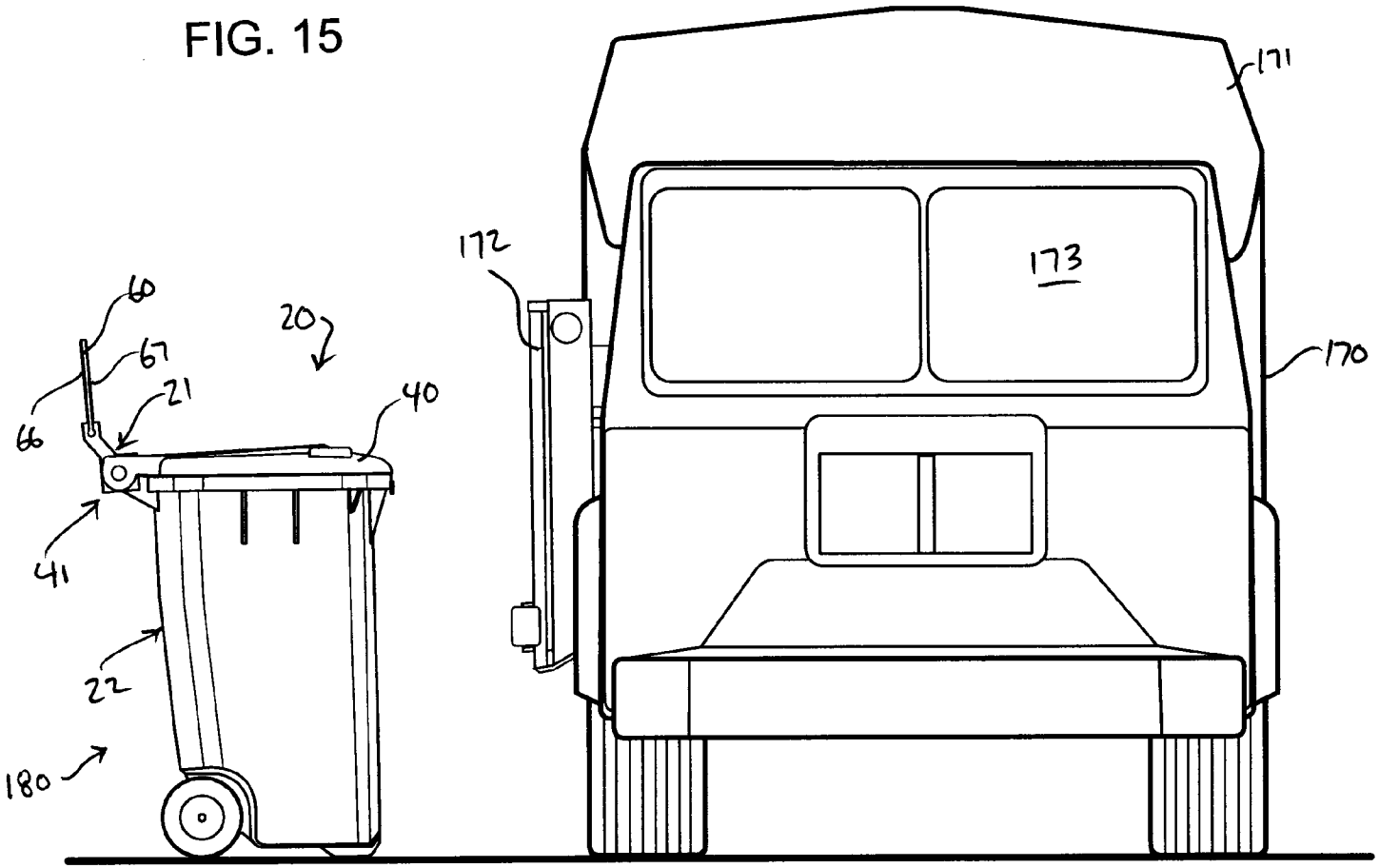

The emptied container 22 is then returned to its initial position by lifting mechanism 172. From the raised inverted emptying position 181 lifting mechanism 172 is then activated by the operator remotely, from cab 173 of truck 170, to lower the engaged container 22 to the ground, moving container 22 along path B, referenced in FIGS. 11-14, from raised inverted emptying position 181 in FIG. 11 to lowered upright position 180 in FIGS. 14 and 15 and onto the ground in FIG. 15 automatically rotating lid 40 from the open position in FIG. 11 to the lowered closed position in FIGS. 14 and 15 under the influence of, or otherwise responsive to, gravity, and throughout this movement there is a concurrent action of the friction between signaling assembly 21 and container 22 automatically holding flag 60 in the raised position signaling, according to the principle of the invention, to the owner or custodian of lidded container assembly 20 that lidded container assembly 20 has been emptied and that lidded container assembly 20 is ready for retrieval. Again, gravity alone is insufficient to overcome the herein-described friction between coupling assembly 70 of signaling assembly 20 and container 22 to rotate flag 60 from the raised position to the lowered position, and that only a force greater than gravity as herein-described is required to overcome the friction between coupling assembly 70 of signaling assembly 21 and container 22 to rotate flag 60 from the raised position to the lowered position. For illustrative purposes, FIG. 12 shows container 22 as it would appear initially lowered by lifting mechanism 172 from the raised inverted emptying position of container 22 in FIG. 11 to an initially lowered position, and FIG. 13 shows container 22 as it would appear lowered by lifting mechanism 172 to an intermediate position between the initially lowered position of container 22 shown in FIG. 12 and the lowered upright position of container 22 shown in FIG. 14 in preparation for being set onto the ground as in FIG. 15. FIG. 15 shows lifting mechanism 172 as it would appear disengaged from container 22 and retracted at the conclusion of the emptying procedure, leading lidded container assembly 20 set on the ground in upright position 180, with lid 40 closed enclosing container 22, and flag 60 held upright responsive to the friction between signaling assembly 21 and container 22 advantageously signaling to the owner or custodian of lidded container assembly 20 that container 22 has been emptied and that lidded container assembly 20 is ready for retrieval after being emptied. At this point, the owner or custodian will know that he may retrieve and reposition lidded container assembly 20 to a convenient location and used to take on refuse until the next scheduled collection period, at which point the lidded container assembly 20 is again moved to the appointed collection site and lid 40 set in the closed position and signaling assembly 21 set with flag 60 in its lowered position on lid 40 as in FIG. 1 in preparation for being emptied by the refuse collection vehicle.

Figure 16:
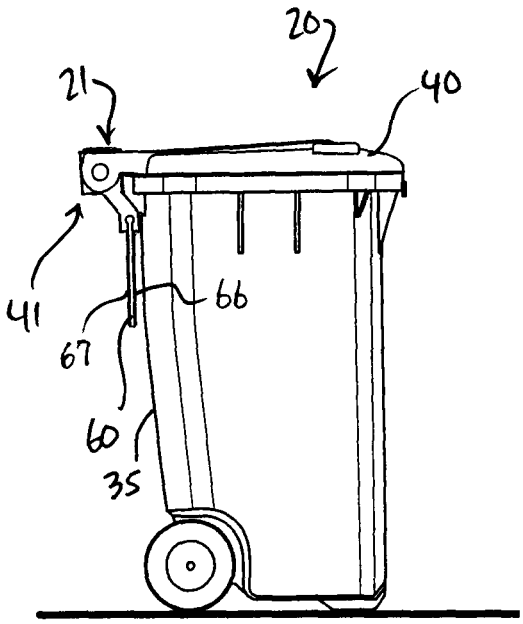
FIG. 16 is a side elevation view of the embodiment of FIG. 1, with the lid in a closed position and the signaling device in a stowage position.

In the lowered position of flag 60 in the closed position of lid 40 as in FIG. 1, flag 60 is horizontal. In the upright position of flag 60, as shown in FIGS. 8, 14, and 15, flag 60 is substantially vertically upright. Again, to rotate flag 60 between its lowered and raised positions, a user need only take up flag 60 by hand and apply a pushing or pulling force, such as on the order of 4-6 pounds, against flag 60 sufficient to overcome the friction between signaling assembly 21 and container 22 to rotate flag to the lowered position or to the raised position. And so when container 22 is used to take on rubbish between scheduled collection periods, a user may rotate flag 60 into the raised position, or even beyond the raised position in the direction of arrowed line C in FIG. 8 to a stowage position extending vertically downward juxtaposed along rear end 35, as shown in FIG. 16, out of the way of opening and closing of lid 40. Again, when the friction between signaling assembly 21 and container 22 is not overcome, the friction holds signaling assembly in a fixed position at any position of flag 60 whether in the lowered position of flag 60 as in FIG. 1, the raised position of flag as shown in FIGS. 7 and 8 and at any position therebetween, in the stowage position extending vertically downward juxtaposed along rear end 35 of container 22 as in FIG. 16, and, moreover, at any position between the lowered position of flag 60 on lid 40 in the closed position of lid 40, and the described stowage position of flag 60 extending vertically downward juxtaposed along rear end 35 of container 22. In other words, flag 60 will remain stuck in place responsive to the disclosed friction between signaling assembly 21 and container 22 in the absence of an applied force sufficient to overcome the friction so as to rotate flag 60. At the time of a scheduled collection, lid 40 is closed and flag 60 may be rotated by hand by an individual into its lowered position over lid 40, as in FIG. 1, in preparation for being emptied.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A lidded container assembly, comprising:

a container, the container includes a body for receiving contents through an opening formed in the container, a lid mounted to the body for rotation between a closed position to enclose the opening and an opened position to open the opening;

a flag extends from a coupling assembly that joins the container and the flag to allow rotation of the flag between a lowered position over the lid in the closed position thereof and a raised position, and friction between the coupling assembly and container resists relative rotation between the flag and the container;

when the container is moved from an upright position to an inverted position, gravity automatically moves the lid from the closed position to the open position, and the lid acts on the flag positioned over the lid to overcome the friction between the coupling assembly and the container to rotate the flag from the lowered position to the raised position; and when the container is subsequently returned from the inverted position to the upright position, gravity automatically moves the lid from the open position to the closed position, the friction between the coupling assembly and the container automatically holds the flag in the raised position, gravity is insufficient to overcome the friction between the coupling assembly and the container to rotate the flag from the raised position to the lowered position, and only a force greater than gravity is required to overcome the friction between the coupling assembly and the container to rotate the flag from the raised position to the lowered position.

2. The lidded container assembly according to claim 1, wherein the container includes a handle, and the coupling assembly joins the handle of the container and the flag.

3. The lidded container assembly according to claim 2, wherein the coupling assembly includes couplers each comprising:

a split collar on the handle; and a clamp assembly clamped on the split collar joins the split collar and the flag to allow rotation of the clamp assembly relative to the split collar to, in turn, allow rotation of the flag relative the split collar and the handle of the hinged connection between the lowered position of the flag and the raised position of the flag, and the friction is between the split collar and the clamp assembly.

4. The lidded container assembly according to claim 3, wherein the split collar is adhesively adhered on the handle.

5. The lidded container assembly according to claim 3, wherein the split collar extends around the handle.

6. The lidded container assembly according to claim 5, wherein the clamp assembly extends around the split collar.

7. The lidded container assembly according to claim 3, further comprising a tongue-and-groove assembly joining the flag to the clamp assembly.

8. A lidded container assembly, comprising:

a container includes a body for receiving contents through an opening formed in the container, a lid, and a hinged connection that joins the body and the lid to allow the lid to rotate relative to the body between a closed position to enclose the opening and an opened position to open the opening;

a flag extends from a coupling assembly that joins the hinged connection and the flag to allow rotation of the flag relative to the hinged connection between a lowered position over the lid in the closed position thereof and a raised position, and friction between the coupling assembly and the hinged connection resists relative rotation between the flag and the hinged connection;

when the container is moved from an upright position to an inverted position, gravity automatically moves the lid from the closed position to the open position, and the lid acts on the flag positioned over the lid to overcome the friction between the coupling assembly and the hinged connection to rotate the flag from the lowered position to the raised position; and when the container is subsequently returned from the inverted position to the upright position, gravity automatically moves the lid from the open position to the closed position, the friction between the coupling assembly and the hinged connection automatically holds the flag in the raised position, gravity is insufficient to overcome the friction between the coupling assembly and the hinged connection to rotate the flag from the raised position to the lowered position relative to the hinged connection, and only a force greater than gravity is required to overcome the friction between the coupling assembly and the hinged connection to rotate the flag from the raised position to the lowered position relative to the hinged connection.

9. The lidded container assembly according to claim 8, wherein the hinged connection includes a handle coupled with the lid and a pair of journals extending from the body and engaging opposed ends of the handle.

10. The lidded container assembly according to claim 9, wherein the coupling assembly is connected to the handle.

11. The lidded container assembly according to claim 10, wherein the coupling assembly includes couplers each comprising:

a split collar on the handle; and a clamp assembly clamped on the split collar joins the split collar and the flag to allow rotation of the clamp assembly relative to the split collar to, in turn, allow rotation of the flag relative the split collar and the handle of the hinged connection between the lowered position of the flag and the raised position of the flag, and the friction is between the split collar and the clamp assembly.

12. The lidded container assembly according to claim 11, wherein the split collar is adhesively adhered on the handle.

13. The lidded container assembly according to claim 11, wherein the split collar extends around the handle.

14. The lidded container assembly according to claim 13, wherein the clamp assembly extends around the split collar.

15. The lidded container assembly according to claim 11, further comprising a tongue-and-groove assembly joining the flag to the clamp assembly.

16. A method for signaling that a lidded container assembly has been emptied and that the lidded container assembly is ready for retrieval after being emptied, wherein the lidded container assembly includes a container having a body for receiving contents through an opening formed in the container, a lid mounted to the body for rotation between a closed position to enclose the opening and an opened position to open the opening, a flag extending from a coupling assembly that joins the container and the flag to allow rotation of the flag between a lowered position over the lid in the closed position thereof and a raised position, and friction between the coupling assembly and container that resists relative rotation between the flag and the container, wherein the method comprises:

locating the container in an upright position with the lid in the closed position and the flag in the lowered position over the lid;

moving the container from the upright position to an inverted emptying position automatically rotating the lid from the closed position to the open position responsive to gravity, and the lid acting on the flag overcoming the friction between the coupling assembly and the hinged connection automatically rotating the flag from the lowered position to the raised position responsive to rotation of the lid from the closed position to the open position; and moving the container from the inverted emptying position to the upright position automatically rotating the lid from the open position to the closed position responsive to gravity, and automatically holding the flag in the raised position responsive to the friction signaling that the lidded container assembly has been emptied and that the lidded container assembly is ready for retrieval, wherein gravity is insufficient to overcome the friction between the coupling assembly and the container to rotate the flag from the raised position to the lowered position, and only a force greater than gravity is required to overcome the friction between the coupling assembly and the container to rotate the flag from the raised position to the lowered position.

17. A method for signaling that a lidded container assembly has been emptied and that the lidded container assembly is ready for retrieval after being emptied, wherein the lidded container assembly includes a container having a body for receiving contents through an opening formed in the container, a lid, and a hinged connection that joins the body and the lid to allow the lid to rotate relative to the body between a closed position to enclose the opening and an opened position to open the opening, a flag extending from a coupling assembly that joins the hinged connection and the flag to allow rotation of the flag relative to the hinged connection between a lowered position over the lid in the closed position thereof and a raised position, and friction between the coupling assembly and the hinged connection that resists relative rotation between the flag and the hinged connection, wherein the method comprises:

locating the container in an upright position with the lid in the closed position and the flag in the lowered position over the lid;

moving the container from the upright position to an inverted emptying position automatically rotating the lid from the closed position to the open position responsive to gravity, and the lid acting on the flag overcoming the friction between the coupling assembly and the hinged connection automatically rotating the flag from the lowered position to the raised position responsive to rotation of the lid from the closed position to the open position; and moving the container from the inverted emptying position to the upright position automatically rotating the lid from the open position to the closed position responsive to gravity, and automatically holding the flag in the raised position responsive to the friction signaling that the lidded container assembly has been emptied and that the lidded container assembly is ready for retrieval, wherein gravity is insufficient to overcome the friction between the coupling assembly and the hinged connection to rotate the flag from the raised position to the lowered position relative to the hinged connection, and only a force greater than gravity is required to overcome the friction between the coupling assembly and the hinged connection to rotate the flag from the raised position to the lowered position relative to the hinged connection.

* * * * *